US010195843B2

(12) United States Patent
Landa et al.

(10) Patent No.: US 10,195,843 B2
(45) Date of Patent: Feb. 5, 2019

(54) DIGITAL PRINTING PROCESS

(71) Applicant: LANDA CORPORATION LTD., Rehovot (IL)

(72) Inventors: Benzion Landa, Nes Ziona (IL); Yehoshua Sheinman, Ra'anana (IL); Sagi Abramovich, Ra'anana (IL); Galia Golodetz, Rehovot (IL); Gregory Nakhmanovich, Rishon Lezion (IL); Meir Soria, Jerusalem (IL)

(73) Assignee: LANDA CORPORATION LTD, Rehovot (IL)

( * ) Notice: Subject to any disclaimer, the term of this patent is extended or adjusted under 35 U.S.C. 154(b) by 0 days.

(21) Appl. No.: 15/674,811

(22) Filed: Aug. 11, 2017

(65) Prior Publication Data

US 2017/0361602 A1 Dec. 21, 2017

Related U.S. Application Data

(63) Continuation-in-part of application No. 15/175,275, filed on Jun. 7, 2016, now Pat. No. 9,776,391, which
(Continued)

(51) Int. Cl.
*B41J 2/00* (2006.01)
*B41J 2/005* (2006.01)
(Continued)

(52) U.S. Cl.
CPC ..... *B41J 2/0057* (2013.01); *B41M 5/0256* (2013.01); *B41M 5/03* (2013.01); *B41N 10/00* (2013.01)

(58) Field of Classification Search
CPC ..... B41J 2/0057; B41J 2002/012
See application file for complete search history.

(56) References Cited

U.S. PATENT DOCUMENTS 2,839,181 A 6/1958 Renner
3,697,551 A 10/1972 Thomson
(Continued)

FOREIGN PATENT DOCUMENTS

CN 1720187 A 1/2006
CN 1261831 C 6/2006
(Continued)

OTHER PUBLICATIONS

BASF , "JONCRYL 537", Datasheet , Retrieved from the internet : Mar. 23, 2007 p. 1.
(Continued)

*Primary Examiner* — Jason S Uhlenhake
(74) *Attorney, Agent, or Firm* — Finnegan, Henderson, Farabow, Garrett & Dunner, LLP

(57) ABSTRACT

A printing system and method are provided. The printing system includes an image forming station for temporarily deposit an image on an intermediate transfer member when the intermediate transfer member in the image forming station is in a first temperature range. The system further includes a drying station configured to increase a temperature of the intermediate transfer member from a first temperature in the first temperature range to a second temperature in a second temperature range, the second temperature being substantially higher than the first temperature. The system further includes an impression station configured to transfer the temporarily deposited image from the intermediate transfer member onto a substrate when the intermediate transfer member in the impression station is in the second temperature range. The system further includes a cooling station for retaining a coolant configured to revert the intermediate transfer member to a temperature in the first temperature.

20 Claims, 10 Drawing Sheets

Related U.S. Application Data is a continuation of application No. 14/382,751, filed as application No. PCT/IB2013/051716 on Mar. 5, 2013, now Pat. No. 9,381,736, application No. 15/674,811, which is a continuation-in-part of application No. 14/917,527, filed as application No. PCT/IB2014/064444 on Sep. 11, 2014, now Pat. No. 9,782,993.

(60) Provisional application No. 61/640,642, filed on Apr. 30, 2012, provisional application No. 61/640,637, filed on Apr. 30, 2012, provisional application No. 61/640,493, filed on Apr. 30, 2012, provisional application No. 61/637,301, filed on Apr. 24, 2012, provisional application No. 61/635,156, filed on Apr. 18, 2012, provisional application No. 61/619,546, filed on Apr. 3, 2012, provisional application No. 61/611,505, filed on Mar. 15, 2012, provisional application No. 61/611,286, filed on Mar. 15, 2012, provisional application No. 61/606,913, filed on Mar. 5, 2012, provisional application No. 61/876,753, filed on Sep. 11, 2013.

(51) Int. Cl.

| | |
|---|---|
| ***B41M 5/025*** | (2006.01) |
| *B41M 5/03* | (2006.01) |
| *B41N 10/00* | (2006.01) |

(56) References Cited

U.S. PATENT DOCUMENTS 3,898,670 A 8/1975 Erikson et al.
3,947,113 A 3/1976 Buchan et al.
4,009,958 A 3/1977 Kurita et al.
4,093,764 A 6/1978 Duckett et al.
4,293,866 A 10/1981 Takita et al.
4,401,500 A 8/1983 Hamada et al.
4,535,694 A 8/1985 Fukuda
4,538,156 A 8/1985 Durkee et al.
4,853,737 A 8/1989 Hartley et al.
4,976,197 A 12/1990 Yamanari et al.
5,012,072 A 4/1991 Martin et al.
5,039,339 A 8/1991 Phan et al.
5,099,256 A 3/1992 Anderson
5,106,417 A 4/1992 Hauser et al.
5,128,091 A 7/1992 Agur et al.
5,190,582 A 3/1993 Shinozuka et al.
5,198,835 A 3/1993 Ando et al.
5,246,100 A 9/1993 Stone et al.
5,305,099 A 4/1994 Morcos
5,352,507 A 10/1994 Bresson et al.
5,406,884 A 4/1995 Okuda et al.
5,471,233 A 11/1995 Okamoto et al.
5,552,875 A 9/1996 Sagiv et al.
5,587,779 A 12/1996 Heeren et al.
5,608,004 A 3/1997 Toyoda et al.
5,613,669 A 3/1997 Grueninger
5,614,933 A 3/1997 Hindman et al.
5,623,296 A 4/1997 Fujino et al.
5,660,108 A 8/1997 Pensavecchia
5,677,719 A 10/1997 Granzow
5,679,463 A 10/1997 Visser et al.
5,698,018 A 12/1997 Bishop et al.
5,723,242 A 3/1998 Woo et al.
5,733,698 A 3/1998 Lehman et al.
5,736,250 A 4/1998 Heeks et al.
5,772,746 A 6/1998 Sawada et al.
5,777,576 A 7/1998 Zur et al.
5,841,456 A 11/1998 Takei et al.
5,859,076 A 1/1999 Kozma et al.
5,880,214 A 3/1999 Okuda
5,883,144 A 3/1999 Bambara et al.
5,883,145 A 3/1999 Hurley et al.
5,884,559 A 3/1999 Okubo et al.
5,891,934 A 4/1999 Moffatt et al.
5,895,711 A 4/1999 Yamaki et al.
5,902,841 A 5/1999 Jaeger et al.
5,923,929 A 7/1999 Ben Avraham et al.
5,929,129 A 7/1999 Feichtinger
5,932,659 A 8/1999 Bambara et al.
5,935,751 A * 8/1999 Matsuoka ..... G03G 9/08782 430/108.8
5,978,631 A 11/1999 Lee
5,978,638 A 11/1999 Tanaka et al.
6,004,647 A 12/1999 Bambara et al.
6,009,284 A 12/1999 Weinberger et al.
6,024,018 A 2/2000 Darel et al.
6,024,786 A 2/2000 Gore
6,033,049 A 3/2000 Fukuda
6,053,438 A 4/2000 Romano, Jr. et al.
6,055,396 A 4/2000 Pang
6,059,407 A 5/2000 Komatsu et al.
6,071,368 A 6/2000 Boyd et al.
6,102,538 A 8/2000 Ochi et al.
6,103,775 A 8/2000 Bambara et al.
6,108,513 A 8/2000 Landa et al.
6,132,541 A 10/2000 Heaton
6,143,807 A 11/2000 Lin et al.
6,166,105 A 12/2000 Santilli et al.
6,195,112 B1 2/2001 Fassler et al.
6,196,674 B1 3/2001 Takemoto
6,213,580 B1 4/2001 Segerstrom et al.
6,214,894 B1 4/2001 Bambara et al.
6,221,928 B1 4/2001 Kozma et al.
6,234,625 B1 5/2001 Wen
6,242,503 B1 6/2001 Kozma et al.
6,257,716 B1 7/2001 Yanagawa et al.
6,262,137 B1 7/2001 Kozma et al.
6,262,207 B1 7/2001 Rao et al.
6,303,215 B1 10/2001 Sonobe et al.
6,316,512 B1 11/2001 Bambara et al.
6,332,943 B1 12/2001 Herrmann et al.
6,354,700 B1 3/2002 Roth
6,357,870 B1 3/2002 Beach et al.
6,358,660 B1 3/2002 Agler et al.
6,363,234 B2 3/2002 Landa et al.
6,364,451 B1 4/2002 Silverbrook
6,383,278 B1 5/2002 Hirasa et al.
6,386,697 B1 5/2002 Yamamoto et al.
6,390,617 B1 5/2002 Iwao
6,397,034 B1 5/2002 Tarnawskyj et al.
6,402,317 B2 6/2002 Yanagawa et al.
6,409,331 B1 6/2002 Gelbart
6,432,501 B1 8/2002 Yang et al.
6,438,352 B1 8/2002 Landa et al.
6,454,378 B1 9/2002 Silverbrook et al.
6,471,803 B1 10/2002 Pelland et al.
6,530,321 B2 3/2003 Andrew et al.
6,530,657 B2 3/2003 Polierer
6,531,520 B1 3/2003 Bambara et al.
6,551,394 B2 4/2003 Hirasa et al.
6,551,716 B1 4/2003 Landa et al.
6,559,969 B1 5/2003 Lapstun
6,575,547 B2 6/2003 Sakuma
6,586,100 B1 7/2003 Pickering et al.
6,590,012 B2 7/2003 Miyabayashi
6,608,979 B1 8/2003 Landa et al.
6,623,817 B1 9/2003 Yang et al.
6,630,047 B2 10/2003 Jing et al.
6,639,527 B2 10/2003 Johnson
6,648,468 B2 11/2003 Shinkoda et al.
6,678,068 B1 1/2004 Richter et al.
6,682,189 B2 1/2004 May et al.
6,685,769 B1 2/2004 Karl et al.
6,704,535 B2 3/2004 Kobayashi et al.
6,709,096 B1 * 3/2004 Beach ..... B41M 5/5218 347/103
6,716,562 B2 4/2004 Uehara et al.
6,719,423 B2 4/2004 Chowdry et al.
6,720,367 B2 4/2004 Taniguchi et al.
6,755,519 B2 6/2004 Gelbart et al.

(56) References Cited

U.S. PATENT DOCUMENTS 6,761,446 B2 7/2004 Chowdry et al.
6,770,331 B1 8/2004 Mielke et al.
6,789,887 B2 9/2004 Yang et al.
6,827,018 B1 12/2004 Hartmann et al.
6,898,403 B2 5/2005 Baker et al.
6,912,952 B1 7/2005 Landa et al.
6,916,862 B2 7/2005 Ota et al.
6,917,437 B1 7/2005 Myers et al.
6,970,674 B2 11/2005 Sato et al.
6,974,022 B2 12/2005 Saeki
6,982,799 B2 1/2006 Lapstun
7,057,760 B2 6/2006 Lapstun et al.
7,084,202 B2 8/2006 Pickering et al.
7,128,412 B2 10/2006 King et al.
7,160,377 B2 1/2007 Zoch et al.
7,204,584 B2 4/2007 Lean et al.
7,224,478 B1 5/2007 Lapstun et al.
7,271,213 B2 9/2007 Hoshida et al.
7,296,882 B2 11/2007 Buehler et al.
7,300,133 B1 11/2007 Folkins et al.
7,300,147 B2 11/2007 Johnson
7,304,753 B1 12/2007 Richter et al.
7,322,689 B2 1/2008 Kohne et al.
7,348,368 B2 3/2008 Kakiuchi et al.
7,360,887 B2 4/2008 Konno
7,362,464 B2 4/2008 Kitazawa
7,459,491 B2 12/2008 Tyvoll et al.
7,527,359 B2 5/2009 Stevenson et al.
7,612,125 B2 11/2009 Muller et al.
7,655,707 B2 2/2010 Ma
7,655,708 B2 2/2010 House et al.
7,699,922 B2 4/2010 Breton et al.
7,708,371 B2 5/2010 Yamanobe
7,709,074 B2 5/2010 Uchida et al.
7,712,890 B2 5/2010 Yahiro
7,732,543 B2 6/2010 Loch et al.
7,732,583 B2 6/2010 Annoura et al.
7,808,670 B2 10/2010 Lapstun et al.
7,810,922 B2 10/2010 Gervasi et al.
7,845,788 B2 12/2010 Oku
7,867,327 B2 1/2011 Sano et al.
7,876,345 B2 1/2011 Houjou
7,910,183 B2 3/2011 Wu
7,919,544 B2 4/2011 Matsuyama et al.
7,942,516 B2 5/2011 Ohara et al.
7,977,408 B2 7/2011 Matsuyama et al.
7,985,784 B2 7/2011 Kanaya et al.
8,002,400 B2 8/2011 Kibayashi et al.
8,012,538 B2 9/2011 Yokouchi
8,025,389 B2 9/2011 Yamanobe et al.
8,042,906 B2 10/2011 Chiwata et al.
8,059,309 B2 11/2011 Lapstun et al.
8,095,054 B2 1/2012 Nakamura
8,109,595 B2 2/2012 Tanaka et al.
8,147,055 B2 4/2012 Cellura et al.
8,177,351 B2 5/2012 Taniuchi et al.
8,186,820 B2 5/2012 Chiwata
8,192,904 B2 6/2012 Nagai et al.
8,215,762 B2 7/2012 Ageishi
8,242,201 B2 8/2012 Goto et al.
8,256,857 B2 9/2012 Folkins et al.
8,263,683 B2 9/2012 Gibson et al.
8,264,135 B2 9/2012 Ozolins et al.
8,295,733 B2 10/2012 Imoto
8,303,072 B2 11/2012 Shibata et al.
8,304,043 B2 11/2012 Nagashima et al.
8,460,450 B2 6/2013 Taverizatshy et al.
8,474,963 B2 7/2013 Hasegawa et al.
8,536,268 B2 9/2013 Karjala et al.
8,546,466 B2 10/2013 Yamashita et al.
8,556,400 B2 10/2013 Yatake et al.
8,693,032 B2 4/2014 Goddard et al.
8,711,304 B2 4/2014 Mathew et al.
8,714,731 B2 5/2014 Leung et al.
8,746,873 B2 6/2014 Tsukamoto et al.
8,779,027 B2 7/2014 Idemura et al.
8,802,221 B2 8/2014 Noguchi et al.
8,894,198 B2 11/2014 Hook et al.
8,919,946 B2 12/2014 Suzuki et al.
9,186,884 B2 11/2015 Landa et al.
9,229,664 B2 1/2016 Landa et al.
9,290,016 B2 3/2016 Landa et al.
9,327,496 B2 5/2016 Landa et al.
9,353,273 B2 5/2016 Landa et al.
9,381,736 B2 7/2016 Landa et al.
9,505,208 B2 11/2016 Shmaiser et al.
9,517,618 B2 12/2016 Landa et al.
9,568,862 B2 2/2017 Shmaiser et al.
9,643,400 B2 5/2017 Landa et al.
9,643,403 B2 5/2017 Landa et al.
9,776,391 B2 10/2017 Landa et al.
9,849,667 B2 12/2017 Landa et al.
9,902,147 B2 2/2018 Shmaiser et al.
9,914,316 B2 3/2018 Landa et al.
2001/0022607 A1 9/2001 Takahashi et al.
2002/0102374 A1 8/2002 Gervasi et al.
2002/0150408 A1 10/2002 Mosher et al.
2002/0164494 A1 11/2002 Grant et al.
2002/0197481 A1 12/2002 Jing et al.
2003/0004025 A1 1/2003 Okuno et al.
2003/0018119 A1 1/2003 Frenkel et al.
2003/0032700 A1 2/2003 Morrison et al.
2003/0055129 A1 3/2003 Alford
2003/0118381 A1 6/2003 Law
2003/0129435 A1 7/2003 Blankenship et al.
2003/0186147 A1 10/2003 Pickering et al.
2003/0214568 A1 11/2003 Nishikawa et al.
2003/0234849 A1 12/2003 Pan et al.
2004/0003863 A1 1/2004 Eckhardt
2004/0020382 A1 2/2004 McLean et al.
2004/0087707 A1 5/2004 Zoch et al.
2004/0228642 A1 11/2004 Iida et al.
2004/0246324 A1 12/2004 Nakashima
2005/0082146 A1 4/2005 Axmann
2005/0110855 A1 5/2005 Taniuchi et al.
2005/0134874 A1 6/2005 Overall et al.
2005/0150408 A1 7/2005 Hesterman
2005/0235870 A1 10/2005 Ishihara
2005/0266332 A1 12/2005 Pavlisko et al.
2006/0135709 A1 6/2006 Hasegawa et al.
2006/0164488 A1 7/2006 Taniuchi et al.
2006/0233578 A1 10/2006 Maki et al.
2007/0014595 A1 1/2007 Kawagoe
2007/0029171 A1 2/2007 Nemedi
2007/0134030 A1 6/2007 Lior et al.
2007/0146462 A1 6/2007 Taniuchi et al.
2007/0176995 A1 8/2007 Kadomatsu et al.
2007/0189819 A1 8/2007 Uehara et al.
2007/0229639 A1 10/2007 Yahiro
2007/0285486 A1 12/2007 Harris et al.
2008/0006176 A1 1/2008 Houjou
2008/0030536 A1 2/2008 Furukawa et al.
2008/0032072 A1 2/2008 Taniuchi et al.
2008/0044587 A1 2/2008 Maeno et al.
2008/0055381 A1 3/2008 Doi et al.
2008/0074462 A1 3/2008 Hirakawa
2008/0138546 A1 6/2008 Soria et al.
2008/0166495 A1 7/2008 Maeno et al.
2008/0167185 A1 7/2008 Hirota
2008/0196612 A1 8/2008 Rancourt et al.
2008/0196621 A1 8/2008 Ikuno et al.
2009/0022504 A1 1/2009 Kuwabara et al.
2009/0041932 A1 2/2009 Ishizuka et al.
2009/0074492 A1 3/2009 Ito
2009/0082503 A1 3/2009 Yanagi et al.
2009/0087565 A1 4/2009 Houjou
2009/0098385 A1 4/2009 Kaemper et al.
2009/0116885 A1 5/2009 Ando
2009/0165937 A1 7/2009 Inoue et al.
2009/0190951 A1 7/2009 Torimaru et al.
2009/0202275 A1 8/2009 Nishida et al.
2009/0211490 A1 8/2009 Ikuno et al.
2009/0237479 A1 9/2009 Yamashita et al.
2009/0315926 A1 12/2009 Yamanobe

(56) References Cited

U.S. PATENT DOCUMENTS

| | | | |
|---|---|---|---|
| 2009/0317555 | A1 | 12/2009 | Hori |
| 2009/0318591 | A1 | 12/2009 | Ageishi et al. |
| 2010/0012023 | A1 | 1/2010 | Lefevre et al. |
| 2010/0066796 | A1 | 3/2010 | Yanagi et al. |
| 2010/0075843 | A1 | 3/2010 | Ikuno et al. |
| 2010/0086692 | A1 | 4/2010 | Ohta et al. |
| 2010/0091064 | A1 | 4/2010 | Araki et al. |
| 2010/0282100 | A1 | 11/2010 | Okuda et al. |
| 2010/0285221 | A1 | 11/2010 | Oki et al. |
| 2010/0303504 | A1 | 12/2010 | Funamoto et al. |
| 2010/0310281 | A1 | 12/2010 | Miura et al. |
| 2011/0044724 | A1 | 2/2011 | Funamoto et al. |
| 2011/0058001 | A1 | 3/2011 | Gila et al. |
| 2011/0085828 | A1 | 4/2011 | Kosako et al. |
| 2011/0141188 | A1 | 6/2011 | Morita |
| 2011/0150541 | A1 | 6/2011 | Michibata |
| 2011/0169889 | A1 | 7/2011 | Kojima et al. |
| 2011/0195260 | A1 | 8/2011 | Lee et al. |
| 2011/0199414 | A1 | 8/2011 | Lang |
| 2011/0234683 | A1 | 9/2011 | Komatsu |
| 2011/0234689 | A1 | 9/2011 | Saito |
| 2011/0269885 | A1 | 11/2011 | Imai |
| 2011/0279554 | A1 | 11/2011 | Dannhauser et al. |
| 2011/0304674 | A1 | 12/2011 | Sambhy et al. |
| 2012/0013694 | A1 | 1/2012 | Kanke |
| 2012/0013928 | A1 | 1/2012 | Yoshida et al. |
| 2012/0026224 | A1 | 2/2012 | Anthony et al. |
| 2012/0039647 | A1 | 2/2012 | Brewington et al. |
| 2012/0098882 | A1* | 4/2012 | Onishi ..... B41J 2/0057 347/18 |
| 2012/0105561 | A1 | 5/2012 | Taniuchi et al. |
| 2012/0113180 | A1 | 5/2012 | Tanaka et al. |
| 2012/0113203 | A1 | 5/2012 | Kushida et al. |
| 2012/0127250 | A1 | 5/2012 | Kanasugi et al. |
| 2012/0127251 | A1 | 5/2012 | Tsuji et al. |
| 2012/0140009 | A1 | 6/2012 | Kanasugi et al. |
| 2012/0156375 | A1 | 6/2012 | Brust et al. |
| 2012/0194830 | A1 | 8/2012 | Gaertner et al. |
| 2012/0237260 | A1 | 9/2012 | Sengoku et al. |
| 2012/0287260 | A1 | 11/2012 | Lu et al. |
| 2013/0088543 | A1 | 4/2013 | Lu et al. |
| 2013/0338273 | A1 | 12/2013 | Shimanaka et al. |
| 2014/0043398 | A1 | 2/2014 | Butler et al. |
| 2014/0104360 | A1 | 4/2014 | Häcker et al. |
| 2014/0339056 | A1 | 11/2014 | Iwakoshi et al. |
| 2015/0024648 | A1 | 1/2015 | Landa et al. |
| 2015/0025179 | A1 | 1/2015 | Landa et al. |
| 2015/0118503 | A1 | 4/2015 | Landa et al. |
| 2015/0336378 | A1 | 11/2015 | Guttmann et al. |
| 2016/0075130 | A1 | 3/2016 | Landa et al. |
| 2016/0207306 | A1 | 7/2016 | Landa et al. |
| 2017/0192374 | A1 | 7/2017 | Landa et al. |
| 2018/0065358 | A1 | 3/2018 | Landa et al. |
| 2018/0079201 | A1 | 3/2018 | Landa et al. |
| 2018/0117906 | A1 | 5/2018 | Landa et al. |
| 2018/0126726 | A1 | 5/2018 | Shmaiser et al. |
| 2018/0134031 | A1 | 5/2018 | Shmaiser et al. |

FOREIGN PATENT DOCUMENTS

| | | | |
|---|---|---|---|
| CN | 1289368 | C | 12/2006 |
| CN | 101177057 | A | 5/2008 |
| CN | 101835611 | A | 9/2010 |
| CN | 102925002 | A | 2/2013 |
| DE | 102010060999 | A1 | 6/2012 |
| EP | 047551 | A2 | 11/1991 |
| EP | 0613791 | A2 | 9/1994 |
| EP | 0784244 | A2 | 7/1997 |
| EP | 0843236 | A2 | 5/1998 |
| EP | 1013466 | A2 | 6/2000 |
| EP | 1158029 | A1 | 11/2001 |
| EP | 2028238 | A1 | 2/2009 |
| EP | 2270070 | A1 | 1/2011 |
| GB | 1520932 | A | 8/1978 |
| JP | S567968 | A | 1/1981 |
| JP | H05147208 | A | 6/1993 |
| JP | H07112841 | A | 5/1995 |
| JP | 2000169772 | A | 6/2000 |
| JP | 2001206522 | A | 7/2001 |
| JP | 2002169383 | A | 6/2002 |
| JP | 2002234243 | A | 8/2002 |
| JP | 2002278365 | A | 9/2002 |
| JP | 2002326733 | A | 11/2002 |
| JP | 2002371208 | A | 12/2002 |
| JP | 2003057967 | A | 2/2003 |
| JP | 2003114558 | A | 4/2003 |
| JP | 2003211770 | A | 7/2003 |
| JP | 2003246484 | A | 9/2003 |
| JP | 2004114377 | A | 4/2004 |
| JP | 2004114675 | A | 4/2004 |
| JP | 2004231711 | A | 8/2004 |
| JP | 2005014255 | A | 1/2005 |
| JP | 2005014256 | A | 1/2005 |
| JP | 2006102975 | A | 4/2006 |
| JP | 2006137127 | A | 6/2006 |
| JP | 2006347081 | A | 12/2006 |
| JP | 2007069584 | A | 3/2007 |
| JP | 2007190745 | A | 8/2007 |
| JP | 2007216673 | A | 8/2007 |
| JP | 2007334125 | A | 12/2007 |
| JP | 2008006816 | A | 1/2008 |
| JP | 2008018716 | A | 1/2008 |
| JP | 2008019286 | A | 1/2008 |
| JP | 2008142962 | A | 6/2008 |
| JP | 2008532794 | A | 8/2008 |
| JP | 2008201564 | A | 9/2008 |
| JP | 2008255135 | A | 10/2008 |
| JP | 2009045794 | A | 3/2009 |
| JP | 2009045885 | A2 * | 3/2009 |
| JP | 2009083317 | A | 4/2009 |
| JP | 2009083325 | A | 4/2009 |
| JP | 2009096175 | A | 5/2009 |
| JP | 2009154330 | A | 7/2009 |
| JP | 2009190375 | A | 8/2009 |
| JP | 2009202355 | A | 9/2009 |
| JP | 2009214318 | A | 9/2009 |
| JP | 2009214439 | A | 9/2009 |
| JP | 2009226852 | A | 10/2009 |
| JP | 2009233977 | A | 10/2009 |
| JP | 2009234219 | A | 10/2009 |
| JP | 2010054855 | A | 3/2010 |
| JP | 2010105365 | A | 5/2010 |
| JP | 2010173201 | A | 8/2010 |
| JP | 2010228192 | A | 10/2010 |
| JP | 2010241073 | A | 10/2010 |
| JP | 2010258193 | A | 11/2010 |
| JP | 2010260204 | A | 11/2010 |
| JP | 2010286570 | A | 12/2010 |
| JP | 2011025431 | A | 2/2011 |
| JP | 2011173325 | A | 9/2011 |
| JP | 2011173326 | A | 9/2011 |
| JP | 2011186346 | A | 9/2011 |
| JP | 2011224032 | A | 11/2011 |
| JP | 2012042943 | A | 3/2012 |
| JP | 2012086499 | A | 5/2012 |
| JP | 2012111194 | A | 6/2012 |
| JP | 2012126123 | A | 7/2012 |
| JP | 2013001081 | A | 1/2013 |
| JP | 2013060299 | A | 4/2013 |
| JP | 2013103474 | A | 5/2013 |
| JP | 2013121671 | A | 6/2013 |
| JP | 2013129158 | A | 7/2013 |
| WO | 8600327 | A1 | 1/1986 |
| WO | 9307000 | A1 | 4/1993 |
| WO | 9736210 | A1 | 10/1997 |
| WO | 9821251 | A1 | 5/1998 |
| WO | 9855901 | A1 | 12/1998 |
| WO | 0170512 | A1 | 9/2001 |
| WO | 2004113082 | A1 | 12/2004 |
| WO | 2004113450 | A1 | 12/2004 |
| WO | 2006069205 | A1 | 6/2006 |
| WO | 2006073696 | A1 | 7/2006 |
| WO | 2006091957 | A2 | 8/2006 |

(56) References Cited

FOREIGN PATENT DOCUMENTS

| | | | |
|---|---|---|---|
| WO | 2007009871 | A2 | 1/2007 |
| WO | 2009025809 | A1 | 2/2009 |
| WO | 2013087249 | A1 | 6/2013 |
| WO | 2013132339 | A1 | 9/2013 |
| WO | 2013132356 | A1 | 9/2013 |
| WO | 2013132418 | A2 | 9/2013 |
| WO | 2013132419 | A1 | 9/2013 |
| WO | 2013132420 | A1 | 9/2013 |
| WO | 2013132424 | A1 | 9/2013 |
| WO | 2013132432 | A1 | 9/2013 |
| WO | 2013136220 | A1 | 9/2013 |
| WO | 2015036864 | A1 | 3/2015 |
| WO | 2015036960 | A1 | 3/2015 |

OTHER PUBLICATIONS

CN101177057 Machine Translation (by EPO and Google)—published May 14, 2008—Hangzhou Yuanyang Industry Co.
CN101835611 Machine Translation (by EPO and Google)—published Sep. 15, 2010—RR Donnelley.
CN102925002 Machine Translation (by EPO and Google)—published Feb. 13, 2013; Jiangnan University, Fu et al.
CN1720187 Machine Translation (by EPO and Google); published on Jan. 11, 2006, RICOH KK, Hideo et al.
Co-pending U.S. Appl. No. 15/871,797, filed Jan. 15, 2018.
DE102010060999 Machine Translation (by EPO and Google)—published Jun. 6, 2012; Wolf, Roland, Dr.-Ing.
JP2000-169772 Machine Translation (by EPO and Google)—published Jun. 20, 2000; Tokyo Ink MFG Co Ltd.
JP2001/206522 Machine Translation (by EPO, PlatPat and Google)—published Jul. 31, 2001; Nitto Denko Corp, Kato et al.
JP2002-169383 Machine Translation (by EPO, PlatPat and Google)—published Jun. 14, 2002 Richo KK.
JP2002-234243 Machine Translation (by EPO and Google)—published Aug. 20, 2002; Hitachi Koki Co Ltd.
JP2002-278365 Machine Translation (by PlatPat English machine translation)—published Sep. 27, 2002 Katsuaki, Ricoh KK.
JP2002-326733 Machine Translation (by EPO, PlatPat and Google)—published Nov. 12, 2002; Kyocera Mita Corp.
JP2002-371208 Machine Translation (by EPO and Google)—published Dec. 26, 2002; Canon Inc.
JP2003-114558 Machine Translation (by EPO, PlatPat and Google)—published Apr. 18, 2003 Mitsubishi Chem Corp, Yuka Denshi Co Ltd, et al.
JP2003-211770 Machine Translation (by EPO and Google)—published Jul. 29, 2003 Hitachi Printing Solutions.
JP2003-246484 Machine Translation (English machine translation)—published Sep. 2, 2003 Kyocera Corp.
JP2004-114377 Machine Translation (by EPO and Google)—published Apr. 15, 2004; Konica Minolta Holdings Inc, et al.
JP2004-114675 Machine Translation (by EPO and Google)—published Apr. 15, 2004; Canon Inc.
JP2004-231711 Machine Translation (by EPO and Google)—published Aug. 19, 2004; Seiko Epson Corp.
JP2005-014255 Machine Translation (by EPO and Google)—published Jan. 20, 2005; Canon Inc.
JP2005-014256 Machine Translation (by EPO and Google)—published Jan. 20, 2005; Canon Inc.
JP2006-102975 Machine Translation (by EPO and Google)—published Apr. 20, 2006; Fuji Photo Film Co Ltd.
JP2006-137127 Machine Translation (by EPO and Google)—published Jun. 1, 2006; Konica Minolta Med & Graphic.
JP2006-347081 Machine Translation (by EPO and Google)—published Dec. 28, 2006; Fuji Xerox Co Ltd.
JP2007-069584 Machine Translation (by EPO and Google)—published Mar. 22, 2007 Fujifilm.
JP2007190745 Machine Translation (by EPO & Google machine translation)—published Aug. 2, 2007 Fuji Xerox Co.
JP2007-216673 Machine Translation (by EPO and Google)—published Aug. 30, 2007 Brother Ind.
JP2007334125 Machine Translation (by EPO and Google)—published Dec. 27, 2007 Ricoh KK; Nisshin Kagaku Kogyo KK.
JP2008-006816 Machine Translation (by EPO and Google)—published Jan. 17, 2008; Fujifilm Corp.
JP2008-018716 Machine Translation (by EPO and Google)—published Jan. 31, 2008; Canon Inc.
JP2008019286 Machine Translation (by PlatPat English machine translation)—published Jan. 31, 2008 Fujifilm Corp.
JP2008-142962 Machine Translation (by EPO and Google)—published Jun. 26, 2008; Fuji Xerox Co Ltd.
JP2008-201564 Machine Translation (English machine translation)—published Sep. 4, 2008 Fuji Xerox Co Ltd.
JP2008-255135 Machine Translation (by EPO and Google)—published Oct. 23, 2008; Fujifilm Corp.
JP2008532794 Machine Translation (by EPO & Google machine translation)—published Oct. 13, 2011 E.I. Dupont De Nemours and Company.
JP2009-045794 Machine Translation (by EPO and Google)—published Mar. 5, 2009; Fujifilm Corp.
JP2009-083317 Abstract; Machine Translation (by EPO and Google)—published Apr. 23, 2009; Fuji Film Corp.
JP2009-083325 Abstract; Machine Translation (by EPO and Google)—published Apr. 23, 2009 Fujifilm.
JP2009096175 Machine Translation (EPO, PlatPat and Google) published on May 7, 2009 Fujifilm Corp.
JP2009-154330 Machine Translation (by EPO and Google)—published Jul. 16, 2009; Seiko Epson Corp.
JP2009-190375 Machine Translation (by EPO and Google)—published Aug. 27, 2009; Fuji Xerox Co Ltd.
P2009-202355 Machine Translation (by EPO and Google)—published Sep. 10, 2009; Fuji Xerox Co Ltd.
P2009-214318 Machine Translation (by EPO and Google)—published Sep. 24, 2009 Fuji Xerox Co Ltd.
JP2009214439 Machine Translation (by PlatPat English machine translation)—published Sep. 24, 2009 Fujifilm Corp.
JP2009-226852 Machine Translation (by EPO and Google)—published Oct. 8, 2009; Hirato Katsuyuki, Fujifilm Corp.
JP2009-233977 Machine Translation (by EPO and Google)—published Oct. 15, 2009; Fuji Xerox Co Ltd.
JP2009-234219 Machine Translation (by EPO and Google)—published Oct. 15, 2009; Fujifilm Corp.
JP2010-054855 Machine Translation (by PlatPat English machine translation)—published Mar. 11, 2010 Itatsu, Fuji Xerox Co.
JP2010-105365 Machine Translation (by EPO and Google)—published May 13, 2010; Fuji Xerox Co Ltd.
JP2010-173201 Abstract; Machine Translation (by EPO and Google)—published Aug. 12, 2010; Riche Co Ltd.
JP2010228192 Machine Translation (by PlatPat English machine translation)—published Oct. 14, 2010 Fuji Xerox.
JP2010-241073 Machine Translation (by EPO and Google)—published Oct. 28, 2010; Canon Inc.
JP2010-286570 Machine Translation (by EPO and Google)—published Dec. 24, 2010 Nakamura, Sharp KK.
JP2011-025431 Machine Translation (by EPO and Google)—published Feb. 10, 2011; Fuji Xerox Co Ltd.
JP2011-173325 Abstract; Machine Translation (by EPO and Google)—published Sep. 8, 2011; Canon Inc.
JP2011-173326 Machine Translation (by EPO and Google)—published Sep. 8, 2011; Canon Inc.
JP2011186346 Machine Translation (by PlatPat English machine translation)—published Sep. 22, 2011 Seiko Epson Corp, Nishimura et al.
JP2011224032 Machine Translation (by EPO & Google)—published Jul. 5, 2012 Canon KK.
JP2012-086499 Machine Translation (by EPO and Google)—published May 10, 2012; Canon Inc.
JP2012-111194 Machine Translation (by EPO and Google)—published Jun. 14, 2012, Konica Minolta.
JP201242943 Machine Translation (by EPO and Google)—published Mar. 1, 2012—Xerox Corporation.

(56) References Cited

OTHER PUBLICATIONS

JPH05147208 Machine Translation (by EPO and Google)—published Jun. 15, 1993—Mita Industrial Co Ltd.
JPS56-7968 Machine Translation (by PlatFat English machine translation); published on Jun. 28, 1979, Shigeyoshi et al.
Machine Translation (by EPO and Google) of JPH70112841 published on May 2, 1995 Canon KK.
Thomas E. F., "CRC Handbook of Food Additives, Second Edition, vol. 1" CRC Press LLC, 1972, p. 231.
WO2013/087249 Machine Translation (by EPO and Google)—published Jun. 20, 2013; Koenig & Bauer AG.

* cited by examiner

DIGITAL PRINTING PROCESS

CROSS-REFERENCE TO RELATED APPLICATIONS

This application is a continuation-in-part of and claims priority from U.S. patent application Ser. No. 15/175,275, filed Jun. 7, 2016, which is a continuation of U.S. patent application Ser. No. 14/382,751, filed on Sep. 3, 2014 (now U.S. Pat. No. 9,381,736), which is a U.S. national application of PCT International Application No. PCT/IB2013/051716, filed Mar. 5, 2013, that claims the benefit of the following U.S. provisional applications: U.S. Provisional Patent Application No. 61/640,642, filed Apr. 30, 2012; U.S. Provisional Patent Application No. 61/640,637, filed Apr. 30, 2012; U.S. Provisional Patent Application No. 61/640,493, filed Apr. 30, 2012; U.S. Provisional Patent Application No. 61/637,301, filed Apr. 24, 2012; U.S. Provisional Patent Application No. 61/635,156, filed Apr. 18, 2012; U.S. Provisional Patent Application No. 61/619,546, filed Apr. 3, 2012; U.S. Provisional Patent Application No. 61/611,505, filed Mar. 15, 2012; U.S. Provisional Patent Application No. 61/611,286, filed Mar. 15, 2012; and U.S. Provisional Patent Application No. 61/606,913, filed Mar. 5, 2012, all of which are incorporated herein by reference. This application is also a continuation-in-part of and claims priority from U.S. patent application Ser. No. 14/917,527, filed Mar. 8, 2016 (pending), which is a U.S. national application of PCT International Application No. PCT/IB2014/064444, filed on Sep. 11, 2014 that claims the benefit of Provisional Patent Application No. 61/876,753, filed on Sep. 11, 2013, all of which are incorporated herein by reference.

FIELD OF THE INVENTION

The present invention relates to a digital printing process.

BACKGROUND

Digital printing techniques have been developed that allow a printer to receive instructions directly from a computer without the need to prepare printing plates. Amongst these are color laser printers that use the xerographic process. Color laser printers using dry toners are suitable for certain applications, but they do not produce images of a photographic quality acceptable for publications, such as magazines.

A process that is better suited for short run high quality digital printing is used in the HP-Indigo printer. In this process, an electrostatic image is produced on an electrically charged image bearing cylinder by exposure to laser light. The electrostatic charge attracts oil-based inks to form a color ink image on the image bearing cylinder. The ink image is then transferred by way of a blanket cylinder onto paper or any other substrate.

Inkjet and bubble jet processes are commonly used in home and office printers. In these processes droplets of ink are sprayed onto a final substrate in an image pattern. In general, the resolution of such processes is limited due to wicking by the inks into paper substrates. The substrate is therefore generally selected or tailored to suit the specific characteristics of the particular inkjet printing arrangement being used. Fibrous substrates, such as paper, generally require specific coatings engineered to absorb the liquid ink in a controlled fashion or to prevent its penetration below the surface of the substrate. Using specially coated substrates is, however, a costly option that is unsuitable for certain printing applications, especially for commercial printing. Furthermore, the use of coated substrates creates its own problems in that the surface of the substrate remains wet and additional costly and time consuming steps are needed to dry the ink, so that it is not later smeared as the substrate is being handled, for example stacked or wound into a roll. Furthermore, excessive wetting of the substrate causes cockling and makes printing on both sides of the substrate (also termed "perfecting" or "duplex" printing) difficult, if not impossible. In addition, inkjet printing directly onto porous paper, or other fibrous material, results in poor image quality because of variation of the distance between the print head and the surface of the substrate.

In commercial settings, there exist additional printing systems, some relying on indirect or offset printing techniques. In such processes, an intermediate image of the final desired pattern (e.g., a mirror image) is typically formed on an image transfer member (e.g., a blanket or a drum) and transferred therefrom to the final printing substrate. The intermediate image can be, as in HP-Indigo printers, an electrostatic image produced on an electrically charged image-bearing cylinder by exposure of compatible oil-based inks to laser light, the ink image being then transferred by way of a blanket cylinder onto paper or any other substrate. Though such systems are better suited for high quality digital printing, the use of oil-based inks has raised environmental concerns.

The present applicant has recently disclosed a printing process wherein inks having an aqueous carrier are jetted onto an intermediate transfer member (ITM) at an image forming station and dried thereupon before being transferred to the desired substrate at an impression station. Few systems implementing such process were disclosed, differing, among other things, in the number of image forming stations, the configurations of the intermediate transfer members, the number of impression stations, and the system architecture allowing duplex printing. More details on such systems are disclosed in PCT Publication Nos. WO 2013/132418, WO 2013/132419 and WO 2013/132420.

Advantageously, such indirect printing systems allow the distance between the outer surface of the intermediate image transfer member (also called the release layer) and the inkjet print head to be maintained constant and reduces wetting of the substrate, as the ink can be dried on the intermediate image transfer member before being applied to the printing substrate. Consequently, the final image quality is less affected by the physical properties of the substrate and benefits from various other advantages as disclosed in PCT Publication Nos. WO 2013/132345, WO 2013/132343 and WO 2013/132340 by the present applicant.

The use of transfer members which receive ink droplets from an ink or bubble jet apparatus to form an ink image and transfer the image to a final substrate have been reported in the patent literature. Various ones of these systems utilize inks having aqueous carriers, non-aqueous carrier liquids or inks that have no carrier liquid at all (solid inks).

The use of aqueous based inks has a number of distinct advantages. Compared to non-aqueous based liquid inks, the carrier liquid is not toxic and there is no problem in dealing with the liquid that is evaporated as the image dries. As compared with solid inks, the amount of material that remains on the printed image can be controlled, allowing for thinner printed images and more vivid colors.

Generally, a substantial proportion or even all of the liquid is evaporated from the image on the intermediate transfer member, before the image is transferred to the final substrate in order to avoid bleeding of the image into the structure of the final substrate. Various methods are described in the literature for removing the liquid, including heating the image and a combination of coagulation of the image particles on the transfer member, followed by removal of the liquid by heating, air knife or other means.

Among the problems surmounted by prior art systems was the need to find a balance between opposite requirements. On the one hand, the printing process, including the materials or formulations employed therewith, should allow transiently fixing the aqueous based ink droplets onto the release layer at the image forming station. On the other hand, the same should allow the dried ink film to be fully transferred to the printing substrate at the impression station.

Generally, silicone coated transfer members are preferred, since this facilitates transfer of the dried image to the final substrate. However, silicone is hydrophobic which causes the ink droplets to bead on the transfer member. This makes it more difficult to remove the water in the ink and also results in a small contact area between the droplet and the blanket that renders the ink image unstable during rapid movement and may makes it more difficult to remove the water from the ink, for instance by heating the transfer member. Surfactants and salts have been used to reduce the surface tension of the droplets of ink so that they do not bead as much. While these do help to alleviate the problem partially, they do not solve it.

Another solution proposed in the above-referenced publications of the Applicant to alleviate this problem was to "freeze" the shape of the impinging jetted droplet in the pancake-like form it adopted upon contact, for instance by rapidly evaporating a substantial proportion of the liquid ink carrier at the stage of the image formation onto the transfer member. The rate of such evaporation depending upon temperature, it was generally preferred for that particular purpose to operate the system at elevated temperatures (e.g., above water boiling point and typically up to 160° C.). However, as the vapors of the ink carrier might, over time, affect the print head nozzles, lower temperatures (e.g., above 40° C.) were also considered for the image forming station.

Alternatively, or additionally, the Applicant disclosed conditioning methods and formulations facilitating the desired interaction between ink formulations and materials composing the release layer suitable for the novel process, by pre-treatment of the transfer member ahead of ink jetting. More details on such methods can be found in PCT Publication No. WO 2013/132339.

Without detracting from the importance of these advances, the present inventors have discovered that under some conditions, surprisingly, some of the aforementioned conditioning solutions may deleteriously accumulate on the transfer member on selected areas. Hence, the present inventors have recognized the need for further improvements in release layer conditioning compositions and technologies. The disclosed printing systems for implementing the methods aspects of the disclosure overcome one or more of the problems set forth above and/or other problems of the prior art.

SUMMARY

In one aspect, the present disclosure describes a printing system configured to employ a moving intermediate transfer member. For example, there is described a system comprising an image forming station for retaining a plurality of print heads configured to temporarily deposit an image on the intermediate transfer member when the intermediate transfer member in the image forming station is in a first temperature range.

The disclosed system further comprises a drying station configured to increase a temperature of the intermediate transfer member from a first temperature in the first temperature range to a second temperature in a second temperature range, the second temperature being substantially higher than the first temperature.

The disclosed system further comprises an impression station spaced from the image forming station and configured to transfer the temporarily deposited image from the intermediate transfer member onto a substrate when the intermediate transfer member in the impression station is in the second temperature range.

The disclosed system further comprises a cooling station for retaining a coolant, spaced from the impression station and from the image forming station, configured to revert the intermediate transfer member to a temperature in the first temperature range by exposing the intermediate transfer member to the coolant, to thereby enable return of the intermediate transfer member, in the first temperature range, to the image forming station.

In another aspect, the present disclosure describes a printing method using the disclosed printing system. For example, there is described a method comprising temporarily depositing an initial image on a moving intermediate transfer member when the intermediate transfer member is in a first temperature range, followed by exposing the intermediate transfer member with the temporarily deposited initial image to heat.

The disclosed method further comprises transferring the temporarily deposited image from the intermediate transfer member onto a substrate when the intermediate transfer member is in a second temperature range substantially higher than the first temperature range, and reverting the intermediate transfer member to a temperature in the first temperature range by exposing the intermediate transfer member to a liquid coolant, to thereby enable returning of the intermediate transfer member, in the first temperature range, to the image forming station.

The disclosed method next comprises temporarily depositing a consecutive image on the moving intermediate transfer member in a consecutive cycle of the intermediate transfer member after reverting the temperature of the intermediate transfer member to the first temperature range.

BRIEF DESCRIPTION OF THE DRAWINGS

Embodiments of the present disclosure will now be described further, by way of example, with reference to the accompanying drawings, in which the dimensions of components and features shown in the figures are chosen for convenience and clarity of presentation and not necessarily to scale. In the drawings.

DETAILED DESCRIPTION

General Overview

Figure 1:
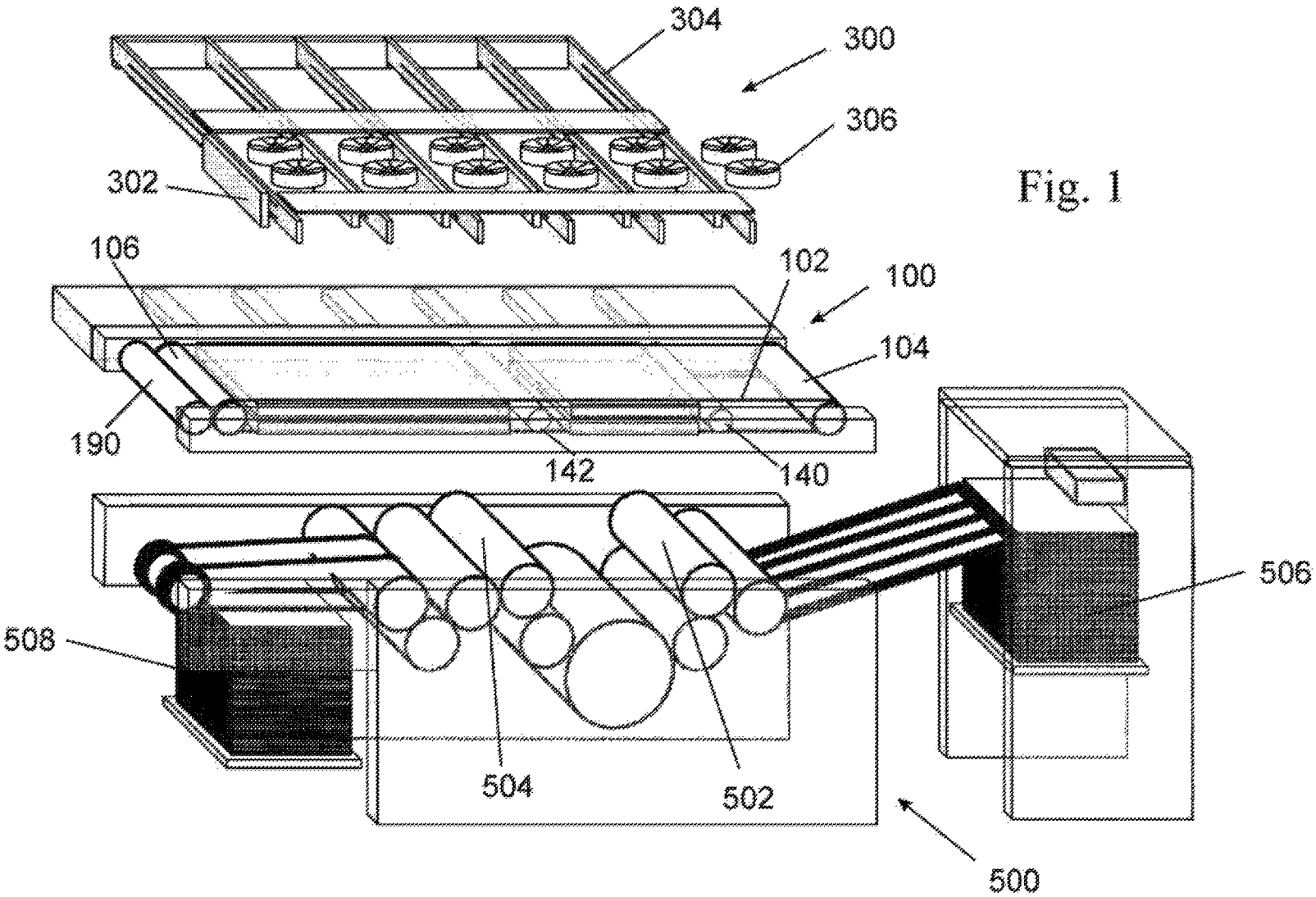
FIG. 1 is an exploded schematic perspective view of a printer in accordance with an embodiment of the disclosure.

There is disclosed here a printing process which comprises directing droplets of an ink onto an intermediate transfer member to form an ink image, the ink including an organic polymeric resin and a coloring agent in an aqueous carrier, and the transfer member having a hydrophobic outer surface, each ink droplet in the ink image spreading or impinging upon the intermediate transfer member to form an ink film; drying the ink while the ink image is being transported by the intermediate transfer member by evaporating the aqueous carrier from the ink image to leave a residue film of resin and coloring agent; and transferring the residue film to a substrate, wherein the chemical compositions of the ink and of the surface of the intermediate transfer member are selected such that attractive intermolecular forces between molecules in the outer skin of each droplet and on the surface of the intermediate transfer member counteract the tendency of the ink film produced by each droplet to bead under the action of the surface tension of the aqueous carrier, without causing each droplet to spread by wetting the surface of the intermediate transfer member.

The phrase "to bead" is used herein to describe the action of surface tension to cause a pancake or disk-like film to contract radially and increase in thickness so as to form a bead, that is to say a near-spherical globule.

The coloring agent may be a pigment, a dye, or combinations thereof. In particular the coloring agents may be pigments having an average particle size D50 of at least 10 nm and of at most 300 nm, however such range may vary for each ink color and in some embodiments the pigments may have a D50 of at most 200 nm or of at most 100 nm.

A hydrophobic outer surface on the intermediate transfer member is desirable as it assists in the eventual transfer of the residue film to the substrate. Such a hydrophobic outer surface or release layer is, however, undesirable during ink image formation because bead-like ink droplets cannot be stably transported by a fast moving intermediate transfer member, and because they result in a thicker film with less coverage of the surface of the substrate. The present disclosure sets out to preserve, or freeze, the thin pancake shape of each ink droplet, that is caused by the flattening of the ink droplet on impacting the surface of the intermediate transfer member, despite the hydrophobicity of the surface of the intermediate transfer member.

To achieve this objective, the disclosure suggest using intermolecular forces between charged molecules in the ink and in the outer surface of the intermediate transfer member, these electrostatic interactions also being known as Van der Waals forces. The molecules in the ink and in the outer surface of the transfer member may be mutually chargeable, becoming oppositely charged upon interaction, a cross-polarization process also referred to as induction or they may be of opposite charge before such interaction.

The "work function" or "surface energy" is a measure of the ease with which electrons can be released from a surface. A conventional hydrophobic surface, such as a silicone coated surface, will yield electrons readily and is regarded as negatively charged. Polymeric resins in an aqueous carrier are likewise generally negatively charged. Therefore, in the absence of additional steps being taken, the net intermolecular forces will cause the intermediate transfer member to repel the ink and the droplets will tend to bead into spherical globules.

In some embodiments, the chemical composition of the surface of the intermediate transfer member is modified to provide a positive charge. This may be achieved, for example, by including in the surface of the intermediate transfer member molecules having one or more Brønsted base functional groups and, in particular, nitrogen comprising molecules. Suitable positively charged or chargeable groups include primary amines, secondary amines, and tertiary amines. Such groups can be covalently bound to polymeric backbones and, for example, the outer surface of the intermediate transfer member may comprise amino silicones.

Such positively chargeable functional groups of the molecules of the release layer may interact with Brønsted acid functional groups of molecules of the ink. Suitable negatively charged or chargeable groups include carboxylated acids such as having carboxylic acid groups (—COOH), acrylic acid groups (—CH2=CH—COOH), methacrylic acid groups (—CH2=C(CH3)-COOH) and sulfonates such as having sulfonic acid groups (—SO3H). Such groups can be covalently bound to polymeric backbones and may be water soluble or dispersible. Suitable ink molecules may, for example, comprise acrylic-based resins such as an acrylic polymer and an acrylic-styrene copolymer having carboxylic acid functional groups.

Incorporating a compound into the transfer member to make the skin of each droplet reversibly attach to the surface of the intermediate transfer member has obvious advantages, but suitable compounds (e.g., amino silicones) that have been found to date, may have only a limited ability to withstand high operating temperatures, eventually shortening the lifespan of the transfer member, unless the printing process is modified to operate at lower temperatures or with shortened periods of high temperature.

An alternative for negating the repelling of the ink droplets by the negatively charged hydrophobic surface of the intermediate transfer member is to apply a conditioning/treatment solution to the surface of the intermediate transfer member to reverse its polarity to positive. One can look upon such treatment of the intermediate transfer member as applying a very thin layer of a positive charge that is itself adsorbed into the surface of the intermediate transfer member but presents on its opposite side a net positive charge with which the negatively charged molecules in the ink may interact.

Chemical agents suitable for the preparation of such conditioning solutions have relatively high charge density and can be a polymer containing amine nitrogen atoms in a plurality of functional groups which need not be the same and can be combined (e.g., primary, secondary, tertiary amines or quaternary ammonium salts). Though macromolecules having a molecular weight from a few hundred to a few thousand can be suitable conditioning agents, it is believed that polymers having a high molecular weight of 10,000 g/mole or more are preferable. Suitable conditioning agents include guar hydroxylpropyltrimonium chloride, hydroxypropyl guar hydroxypropyl-trimonium chloride, linear or branched polyethylene imine, modified polyethylene imine, vinyl pyrrolidone dimethylaminopropyl methacrylamide copolymer, vinyl caprolactam dimethylaminopropyl methacrylamide hydroxyethyl methacrylate, quaternized vinyl pyrrolidone dimethylaminoethyl methacrylate copolymer, poly(diallyldimethyl-ammonium chloride), poly(4-vinylpyridine) and polyallylamine.

Chemical agents having a high charge density, such as polyethylenimine (PEI), have been found to be particularly effective in preventing the ink droplets from beading up after impacting the surface of the intermediate transfer member.

The chemical agent may be applied as a dilute, preferably aqueous, solution. The solution may be heated to evaporate the solvent prior to the ink image formation, whereby the ink droplets are directed onto a substantially dry surface.

It has been found experimentally that if a single droplet of a dilute PEI solution is dropped onto the hydrophobic surface and immediately blown away and evaporated by a stream of high pressure air, ink droplets will only thereafter adhere without beading up on the parts of the surface that have come into contact with the dilute PEI solution, even only for such a brief instant. As such application can only leave a layer having a thickness of a very few molecules (possibly only a monolayer), the interaction with ink cannot be a stoichiometric chemical one, having regard to the significant difference between the mass of the PEI layer and the mass of the ink droplets.

The amount of charge on the transfer member is too small to attract more than a small number of particles in the ink, so that, it is believed, the concentration and distribution of particles in the drop is not substantially changed. Moreover, the time period during which such interaction may take place is relatively short, being at most few seconds and generally less than one.

It has been found, surprisingly, that the intermolecular attraction has a profound effect on the shape of the droplets after they stabilize. To revert from a pancake or disk-like shape to a spherical globule, surface tension needs to peel the skin of the ink droplet away from the surface of the intermediate transfer member. The intermolecular forces, however, resist such separation of the skin of the droplet from the surface and the result is a relatively flat droplet of ink of greater extent than a droplet of the same volume deposited on the same surface without such conditioning. Furthermore, since in areas that are not reached by the droplet the effective hydrophobic nature of the transfer member is maintained, there is little or no spreading of the droplet above that achieved in the initial impact and the boundaries of the droplet are distinct; in other words there is no wetting by the ink droplets of the surface of the intermediate transfer member, thus resulting in droplets having a regular rounded outline.

Further details on conditioning solutions suitable for printing processes and systems according to the present disclosure are disclosed in co-pending PCT Application No. PCT/IB2013/000757 (Agent's reference LIP 12/001 PCT).

In some embodiments, the intermediate transfer member is a blanket of which the outer surface is the hydrophobic outer surface upon which the ink image is formed. It is however alternatively possible for the intermediate transfer member to be constructed as a drum.

In accordance with a feature of some embodiments, prior to transferring the residue film onto the substrate, the ink image is heated to a temperature at which the residue film of resin and coloring agent that remains after evaporation of the aqueous carrier is being softened. Softening of the polymeric resin may render it tacky and increases its ability to adhere to the substrate as compared to its previous ability to adhere to the transfer member.

The temperature of the tacky residue film on the intermediate transfer member may be higher than the temperature of the substrate, whereby the residue film cools during adhesion to the substrate.

By suitable selection of the thermo-rheological characteristics of the residue film the effect of the cooling may be to increase the cohesion of the residue film, whereby its cohesion exceeds its adhesion to the transfer member so that substantially all of the residue film is separated from the intermediate transfer member and impressed as a film onto the substrate. In this way, it is possible to ensure that the residue film is impressed on the substrate without significant modification to the area covered by the film nor to its thickness.

Still further disclosed herein is a substrate printed using an aqueous based ink, wherein the printed image is formed by a plurality of ink dots and each ink dot is constituted by a film of substantially uniform thickness, the printed image overlying the outer surface of the substrate without penetrating beyond the surface roughness of the substrate. The average film thickness may not exceed 1500 nm, 1200 nm, 1000 nm, 800 nm and may be of 500 nanometers or less; and may be of at least 50 nm, at least 100 nm, or at least 150 nm.

In an embodiment of the disclosure, each ink dot in the image, that does not merge into an adjacent ink dot, has a regular rounded outline.

A feature of some embodiments of the disclosure is concerned with the composition of the ink. The ink may utilize an aqueous carrier, which reduces safety concerns and pollution issues that occur with inks that utilize volatile hydrocarbon carrier. In general, the ink must have the physical properties that are needed to apply very small droplets close together on the transfer member. Other necessary characteristics of the ink will become clear in the discussion below of the process.

Other effects that may contribute to the shape of the droplet remaining in the flattened configuration are, quick heating of the droplets to increase their viscosity, a barrier (a polymer coating or a conditioning agent) that reduces the hydrophobic effect of the silicone layer, and a surfactant that reduces the surface tension of the ink.

In general, ink jet printers require a trade-off between purity of the color, the ability to produce complete coverage of a surface and the density of the ink-jet nozzles. If the droplets (after beading) are small, then, in order to achieve complete coverage, it is necessary to have the droplets close together. However, it is very problematic (and expensive) to have the droplets closer than the distance between pixels. By forming relatively flat droplet films that are held in place in the manner described above, the coverage caused by the droplets can be close to complete.

In some embodiments, the carrier liquid in the image is evaporated from the image after it is formed on the transfer member. Since the coloring agent in the droplets is dispersed or dissolved within the droplet, one method for removal of the liquid is by heating the image, either by heating the transfer member or by external heating of the image after it is formed on the transfer member, or by a combination of both.

In some embodiments, the carrier is evaporated by blowing a heated gas (e.g., air) over the surface of the transfer member.

In some embodiments, different ink colors are applied sequentially to the surface of the intermediate transfer member and a heated gas is blown onto the droplets of each ink color after their deposition but before deposition on the intermediate transfer member of the next ink color. In this way, merging of ink droplets of different colors with one another is reduced.

In one embodiment, the polymeric resin in the ink is a polymer that forms a residue film when it is heated (the term residue film is used herein to refer to the ink droplets after they have been dried). Acrylic polymers and acrylic-styrene co-polymers with an average molecular weight around 60,000 g/mole have been found to be suitable. Further details of non-limiting examples of ink compositions suitable for the printing processes and systems of the present disclosure are disclosed in co-pending PCT Application No. PCT/IB2013/051755 (Agent's reference LIP 11/001 PCT).

In one embodiment, all of the liquid is evaporated, however, a small amount of liquid that does not interfere with the forming of a film may be present.

The formation of a residue film may have a number of advantages. The first of these is that when the image is transferred to the final substrate all, or nearly all, of the image can be transferred. This allows for a system without a permanently engaged cleaning station for removing residues from the transfer member. Another more profound advantage is that it allows for the image to be attached to the substrate with a constant thickness of the image covering the substrate. Additionally, it prevents the penetration of the image beneath the surface of the substrate.

In general, when an image is transferred to or formed on a substrate while it is still liquid, the image penetrates into the fibers of the substrate and beneath its surface. This causes uneven color and a reduction in the depth of the color, since some of the coloring agent is blocked by the fibers.

In accordance with another embodiment of the disclosure, the residue film may be very thin, for example, below 1500 nanometers, between 10 nm and 800 nm, or between 50 nm and 500 nm. Such thin films are transferred intact to the substrate and, because they are so thin, replicate the surface of the substrate by closely following its contours. This results in a much smaller difference in the gloss of the substrate between printed and non-printed areas.

When the residue film reaches an impression station at which it is transferred from the intermediate transfer member to the final substrate, it is pressed against the substrate, which may have been previously heated to a temperature at which it becomes tacky in order to attach itself to the substrate.

In one embodiment, the substrate, which is generally not heated, cools the image so that it solidifies and transfers to the substrate without leaving any residue film on the surface of the intermediate transfer member. For this cooling to be effective, additional constraints are placed on the polymer in the ink.

The fact that the carrier is termed an aqueous carrier is not intended to preclude the presence of certain organic materials in the ink, in particular, certain innocuous water miscible organic material and/or co-solvents, however, substantially all of the volatile material in the ink may be water.

As the outer surface of the intermediate transfer member is hydrophobic, and therefore not water absorbent, there may be substantially no swelling, which was found to distort the surface of transfer members in commercially available products utilizing silicone coated transfer members and hydrocarbon carrier liquids. Consequently, the process described above may achieve a highly smooth release surface, as compared to intermediate transfer member surfaces of the prior art.

As the image transfer surface is hydrophobic, and therefore not water absorbent, substantially all the water in the ink should be evaporated away if wetting of the substrate is to be avoided.

A more detailed description of the printing system, including some components of it, and methods of printing using it are provided in the FIGS. 1-14. Referring to the printer presented in FIGS. 1 and 2, there is shown three separate and mutually interacting systems, namely a blanket system 100, an image forming system 300 above the blanket system 100 and a substrate transport system 500 below the blanket system 100.

The blanket system 100 comprises an endless belt or blanket 102 that acts as an intermediate transfer member and is guided over two rollers 104, 106. An image made up of dots of an aqueous ink is applied by image forming system 300 to an upper run of blanket 102 at a location referred herein as the image forming station. A lower run selectively interacts at two impression stations with two impression cylinders 502 and 504 of the substrate transport system 500 to impress an image onto a substrate compressed between the blanket 102 and the respective impression cylinder 502, 504 by the action of respective pressure or nip rollers 140, 142. As will be explained below, the purpose of there being two impression cylinders 502, 504 is to permit duplex printing. In the case of a simplex printer, only one impression station would be needed. The printer shown in FIGS. 1 and 2 can print single sided prints at twice the speed of printing double sided prints. In addition, mixed lots of single and double sided prints can also be printed.

In operation, ink images, each of which is a mirror image of an image to be impressed on a final substrate, are printed by the image forming system 300 onto an upper run of blanket 102. In this context, the term "run" is used to mean a length or segment of the blanket between any two given rollers over which the blanket is guided. While being transported by the blanket 102, the ink is heated to dry it by evaporation of most, if not all, of the liquid carrier. The ink image is furthermore heated to render tacky the film of ink solids remaining after evaporation of the liquid carrier, this film being referred to as a residue film, to distinguish it from the liquid film formed by flattening of each ink droplet. At the impression cylinders 502, 504 the image is impressed onto individual sheets 501 of a substrate which are conveyed by the substrate transport system 500 from an input stack 506 to an output stack 508 via the impression cylinders 502, 504.

Though not shown in the figures, the blanket system may further comprise a cleaning station which may be used periodically to "refresh" the blanket or in between printing jobs. The cleaning station may comprise one or more devices configured to remove gently any residual ink images or any other trace particle from the release layer. In one embodiment, the cleaning station may comprise a device configured to apply a cleaning fluid to the surface of the transfer member, for example a roller having cleaning liquid on its circumference, which may be replaceable (e.g., a pad or piece of paper). Residual particles may optionally be further removed by an absorbent roller or by one or more scraper blades.

Blanket and Blanket Support System

The blanket 102, in one embodiment of the disclosure, is seamed. In particular, the blanket is formed of an initially flat strip of which the ends are fastened to one another, releasably or permanently, to form a continuous loop. A releasable fastening may be a zip fastener or a hook and loop fastener that lies substantially parallel to the axes of rollers 104 and 106 over which the blanket is guided. A permanent fastening may be achieved by the use of an adhesive or a tape.

In order to avoid a sudden change in the tension of the blanket as the seam passes over these rollers, it is desirable to make the seam, as nearly as possible, of the same thickness as the remainder of the blanket. It is also possible to incline the seam relative to the axis of the rollers but this would be at the expense of enlarging the non-printable image area.

Alternatively, the blanket can be seamless, hence relaxing certain constraints from the printing system (e.g., synchronization of seam's position). Whether seamless or not, the primary purpose of the blanket is to receive an ink image from the image forming system and to transfer that image dried but undisturbed to the impression stations. To allow easy transfer of the ink image at each impression station, the blanket may have a thin upper release layer that is hydrophobic. The outer surface of the transfer member upon which the ink can be applied may comprise a silicone material. Under suitable conditions, a silanol-, sylyl- or silane-modified or terminated polydialkylsiloxane silicone material and amino silicones have been found to work well. However the exact formulation of the silicone is not critical as long as the selected material allows for release of the image from the transfer member to a final substrate. Further details of non-limiting examples of release layers and intermediate transfer members are disclosed in co-pending PCT Applications No. PCT/IB2013/051743 (Agent's reference LIP 10/002 PCT) and No. PCT/IB2013/051751 (Agent's reference LIP 10/005 PCT). Suitably, the materials forming the release layer allow it to be not absorbent.

In some embodiments, the silanol-terminated polydialkylsiloxane silicone may have the formula:

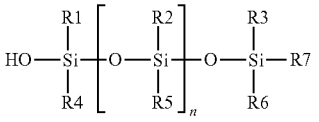

where R1 to R6 are each independently a saturated or unsaturated, linear, branched or cyclic $C_1$ to $C_6$ alkyl group; R7 is selected from the group consisting of OH, H or a saturated or unsaturated, linear, branched or cyclic $C_1$ to $C_6$ alkyl group; and n is an integer from 50 to 400. The curable silicone may be cured by condensation curing.

In one embodiment, the material of the release layer is selected so that the transfer member does not swell (or is not solvated) by the carrier liquid of the ink or of any other fluid that may be applied to its outer surface. In some embodiments, the swelling of the release layer is of at most 1.5% by weight or of at most 1%, the swelling being assessed for 20 hours at 100° C.

The strength of the blanket can be derived from a support or reinforcement layer. In one embodiment, the reinforcement layer is formed of a fabric. If the fabric is woven, the warp and weft threads of the fabric may have a different composition or physical structure so that the blanket should have, for reasons to be discussed below, greater elasticity in its width ways direction (parallel to the axes of the rollers 104 and 106) than in its length ways direction, in which it may be substantially non-extendible. In one embodiment, the fibers of the reinforcement layer in the longitudinal direction are substantially aligned with the printing direction and are made of high performance fibers (e.g., aramid, carbon, ceramic, glass fibers etc.).

The blanket may comprise additional layers between the reinforcement layer and the release layer, for example to provide conformability and compressibility of the release layer to the surface of the substrate. Other layers provided on the blanket may act as a thermal reservoir or a thermal partial barrier and/or to allow an electrostatic charge to the applied to the release layer. An inner layer may further be provided to control the frictional drag on the blanket as it is rotated over its support structure. Other layers may be included to adhere or connect the afore-mentioned layers one with another or to prevent migration of molecules therebetween.

Figure 3:
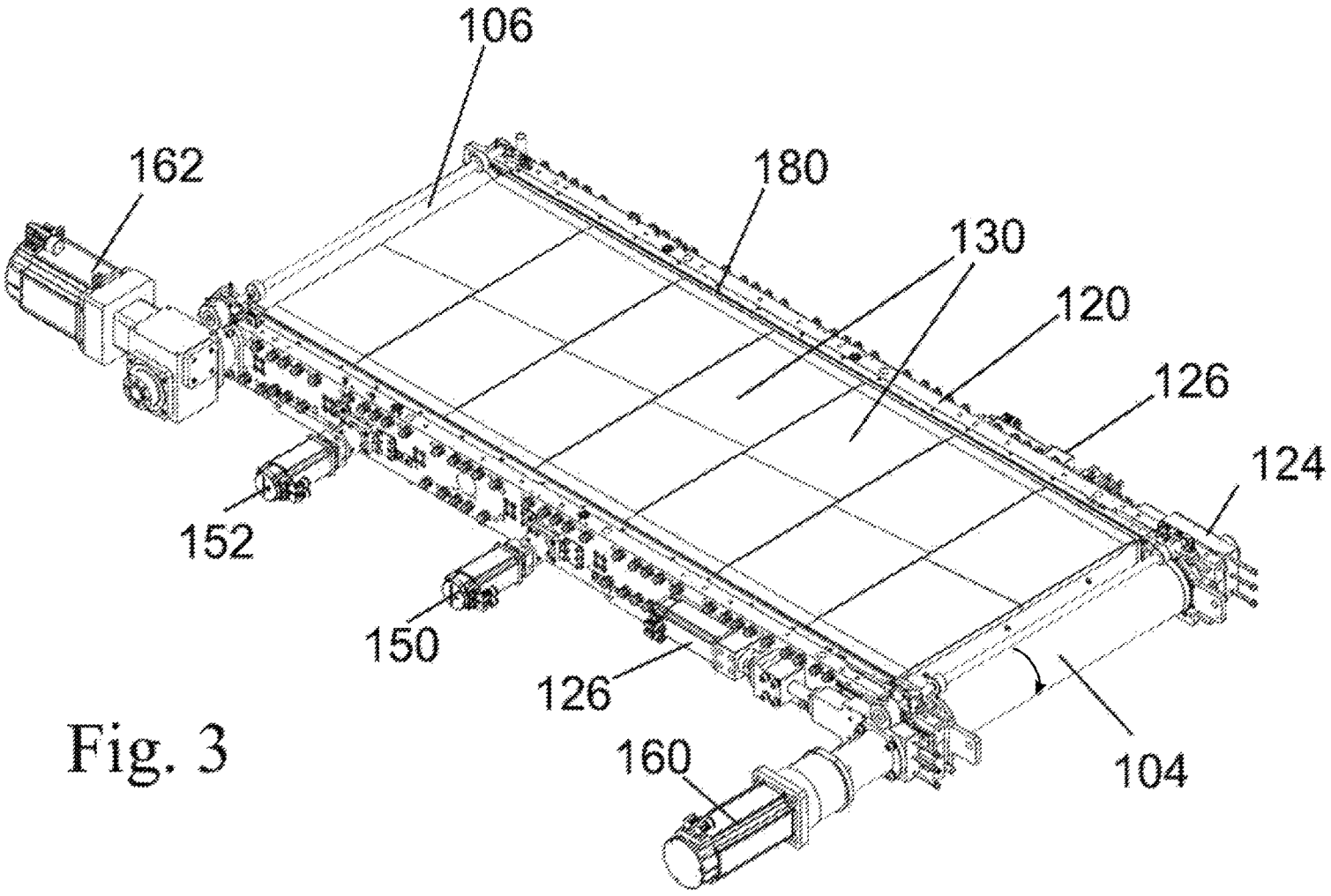
FIG. 3 is a perspective view of a blanket support system, in accordance with an embodiment of the disclosure, with the blanket removed.
Figure 4:
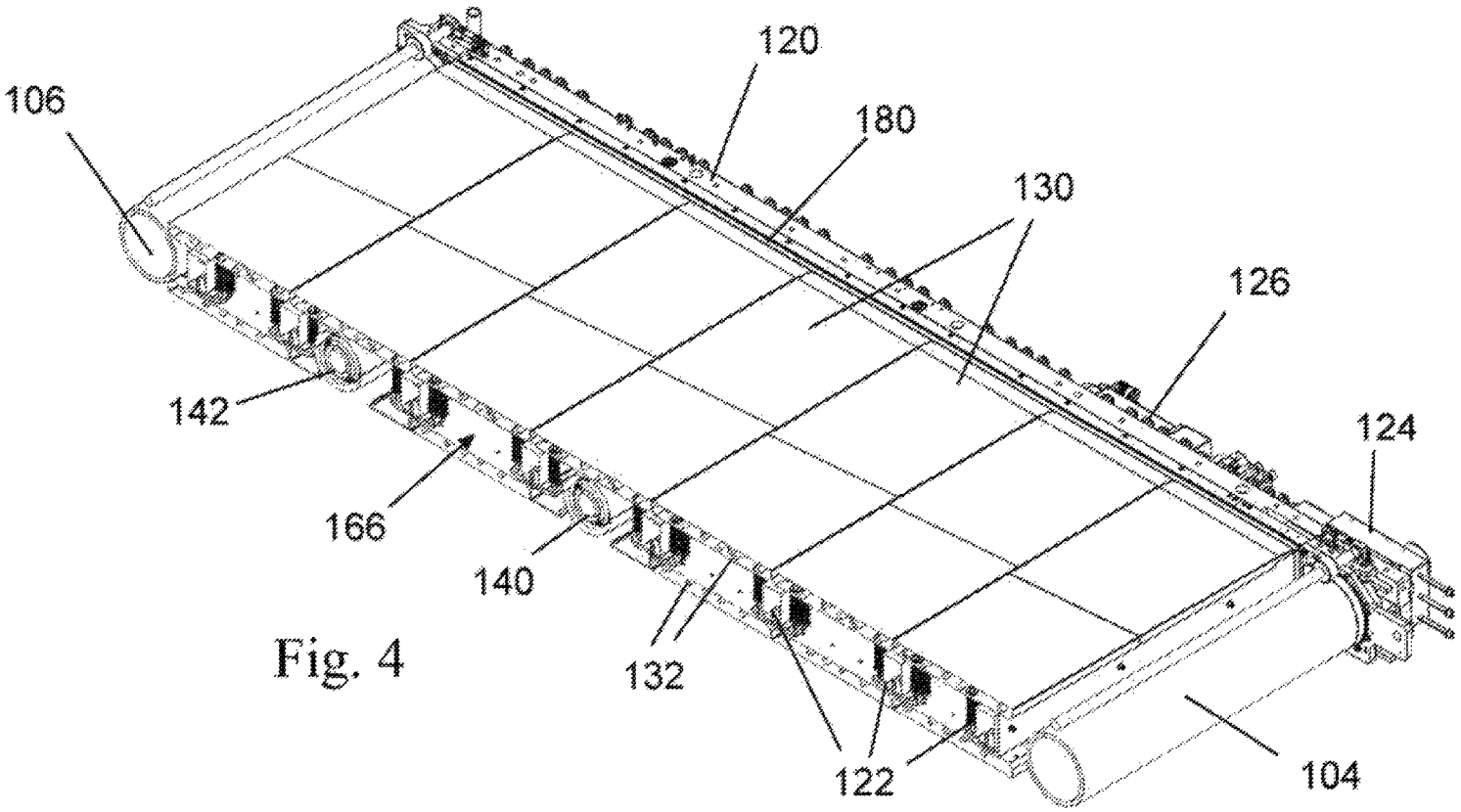
FIG. 4 shows a section through the blanket support system of FIG. 3 showing its internal construction.

The structure supporting the blanket in the embodiment of FIG. 1 is shown in FIGS. 3 and 4. Two elongate outriggers 120 are interconnected by a plurality of cross beams 122 to form a horizontal ladder-like frame on which the remaining components are mounted.

The roller 106 is journalled in bearings that are directly mounted on outriggers 120. At the opposite end, however, roller 104 is journalled in pillow blocks 124 that are guided for sliding movement relative to outriggers 120. Motors 126, for example electric motors, which may be stepper motors, act through suitable gearboxes to move the pillow blocks 124, so as to alter the distance between the axes of rollers 104 and 106, while maintaining them parallel to one another.

Thermally conductive support plates 130 are mounted on cross beams 122 to form a continuous flat support surface both on the top side and bottom side of the support frame. The junctions between the individual support plates 130 are intentionally offset from each other (e.g., zigzagged) in order to avoid creating a line running parallel to the length of the blanket 102. Electrical heating elements 132 are inserted into transverse holes in plates 130 to apply heat to the plates 130 and through plates 130 to the upper run of blanket 102. Other means for heating the upper run will occur to the person of skill in the art and may include heating from below, above, or within the blanket itself. The heating plates may also serve to heat the lower run of the blanket at least until transfer takes place.

Also mounted on the blanket support frame are two pressure or nip rollers 140, 142. The pressure rollers are located on the underside of the support frame in gaps between the support plates 130 covering the underside of the frame. The pressure rollers 140, 142 are aligned respectively with the impression cylinders 502, 504 of the substrate transport system, as shown most clearly in FIGS. 2 and 5. Each impression cylinder and corresponding pressure roller, when engaged as described below, form an impression station.

Each of the pressure rollers 140, 142 may be mounted so that it can be raised and lowered from the lower run of the blanket. In one embodiment each pressure roller is mounted on an eccentric that is rotatable by a respective actuator 150, 152. When it is raised by its actuator to an upper position within the support frame, each pressure roller is spaced from the opposing impression cylinder, allowing the blanket to pass by the impression cylinder while making contact with neither the impression cylinder itself nor with a substrate carried by the impression cylinder. On the other hand, when moved downwards by its actuator, each pressure roller 140, 142 projects downwards beyond the plane of the adjacent support plates 130 and deflects part of the blanket 102, forcing it against the opposing impression cylinder 502, 504. In this lower position, it presses the lower run of the blanket against a final substrate being carried on the impression roller (or the web of substrate in the embodiment of FIG. 5).

The rollers 104 and 106 are connected to respective electric motors 160, 162. The motor 160 is more powerful and serves to drive the blanket clockwise as viewed in FIGS. 3 and 4. The motor 162 provides a torque reaction and can be used to regulate the tension in the upper run of the blanket. The motors may operate at the same speed in an embodiment in which the same tension is maintained in the upper and lower runs of the blanket.

In an alternative embodiment of the disclosure, the motors 160 and 162 are operated in such a manner as to maintain a higher tension in the upper run of the blanket where the ink image is formed and a lower tension in the lower run of the blanket. The lower tension in the lower run may assist in absorbing sudden perturbations caused by the abrupt engagement and disengagement of the blanket 102 with the impression cylinders 502 and 504.

It should be understood that in an embodiment of the disclosure, pressure rollers 140 and 142 can be independently lowered and raised such that both, either or only one of the rollers is in the lower position engaging with its respective impression cylinder and the blanket passing therebetween.

In an embodiment of the disclosure, a fan or air blower (not shown) is mounted on the frame to maintain a sub-atmospheric pressure in the volume 166 bounded by the blanket and its support frame. The negative pressure serves to maintain the blanket flat against the support plates 130 on both the upper and the lower side of the frame, in order to achieve good thermal contact. If the lower run of the blanket is set to be relatively slack, the negative pressure would also assist in maintaining the blanket out of contact with the impression cylinders when the pressure rollers 140, 142 are not actuated.

In an embodiment of the disclosure, each of the outriggers 120 also supports a continuous track 180, which engages formations on the side edges of the blanket to maintain the blanket taut in its width ways direction. The formations may be spaced projections, such as the teeth of one half of a zip fastener sewn or otherwise attached to the side edge of the blanket. Alternatively, the formations may be a continuous flexible bead of greater thickness than the blanket. The lateral track guide channel may have any cross-section suitable to receive and retain the blanket lateral formations and maintain it taut. To reduce friction, the guide channel may have rolling bearing elements to retain the projections or the beads within the channel.

To mount a blanket on its support frame, according to one embodiment of the disclosure, entry points are provided along tracks 180. One end of the blanket is stretched laterally and the formations on its edges are inserted into tracks 180 through the entry points. Using a suitable implement that engages the formations on the edges of the blanket, the blanket is advanced along tracks 180 until it encircles the support frame. The ends of the blanket are then fastened to one another to form an endless loop or belt. Rollers 104 and 106 can then be moved apart to tension the blanket and stretch it to the desired length. Sections of tracks 180 are telescopically collapsible to permit the length of the track to vary as the distance between rollers 104 and 106 is varied.

In one embodiment, the ends of the blanket elongated strip are advantageously shaped to facilitate guiding of the blanket through the lateral tracks or channels during installation. Initial guiding of the blanket into position may be done for instance by securing the leading edge of the blanket strip introduced first in between the lateral channels 180 to a cable which can be manually or automatically moved to install the belt. For example, one or both lateral ends of the blanket leading edge can be releasably attached to a cable residing within each channel. Advancing the cable(s) advances the blanket along the channel path. Alternatively or additionally, the edge of the belt in the area ultimately forming the seam when both edges are secured one to the other can have lower flexibility than in the areas other than the seam. This local "rigidity" may ease the insertion of the lateral projections of the blanket into their respective channels.

Following installation, the blanket strip may be adhered edge to edge to form a continuous belt loop by soldering, gluing, taping (e.g., using Kapton® tape, RTV liquid adhesives or PTFE thermoplastic adhesives with a connective strip overlapping both edges of the strip), or any other method commonly known. Any method of joining the ends of the belt may cause a discontinuity, referred to herein as a seam, and it is desirable to avoid an increase in the thickness or discontinuity of chemical and/or mechanical properties of the belt at the seam.

Further details of non-limiting examples of formations suitable for blankets or belts that may be used in the printing systems of the present disclosure, as well as of methods for installing the same, are disclosed in co-pending PCT Application No. PCT/IB2013/051719 (Agent's reference LIP 7/005 PCT).

In order for the image to be properly formed on the blanket and transferred to the final substrate and for the alignment of the front and back images in duplex printing to be achieved, a number of different elements of the system must be properly synchronized. In order to position the images on the blanket properly, the position and speed of the blanket must be both known and controlled. In an embodiment of the disclosure, the blanket is marked at or near its edge with one or more markings spaced in the direction of motion of the blanket. One or more sensors 107 sense the timing of these markings as they pass the sensor. The speed of the blanket and the speed of the surface of the impression rollers should be the same, for proper transfer of the images to the substrate from the transfer blanket. Signals from the sensor(s) 107 are sent to a controller 109 which also receives an indication of the speed of rotation and angular position of the impression rollers, for example from encoders on the axis of one or both of the impression rollers (not shown). Sensor 107, or another sensor (not shown) also determines the time at which the seam of the blanket passes the sensor. For maximum utility of the usable length of the blanket, it is desirable that the images on the blanket start as close to the seam as feasible.

The controller controls the electric motors 160 and 162 to ensure that the linear speed of the blanket is the same as the speed of the surface of the impression rollers.

Because the blanket contains an unusable area resulting from the seam, it is important to ensure that this area always remains in the same position relative to the printed images in consecutive cycles of the blanket. Also, in one embodiment, to ensure that whenever the seam passes the impression cylinder, it should always coincides with a time when a discontinuity in the surface of the impression cylinder (accommodating the substrate grippers to be described below) faces pressure blanket.

In one embodiment, the length of the blanket is set to be a whole number multiple of the circumference of the impression cylinders 502, 504. In embodiments wherein the impression cylinder may accommodate two sheets of substrate, the length of the blanket may be a whole multiple of half the circumference of an impression cylinder. Since the length of the blanket 102 changes with time, the position of the seam relative to the impression rollers may be changed, by momentarily changing the speed of the blanket. When synchronism is again achieved, the speed of the blanket is again adjusted to match that of the impression rollers, when it is not engaged with the impression cylinders 502, 504. The length of the blanket can be determined from a shaft encoder measuring the rotation of one of rollers 104, 106 during one sensed complete revolution of the blanket.

The controller also controls the timing of the flow of data to the print bars and may control proper timing of any optional sub-system of the printing system, as known to persons skilled in the art of printing.

This control of speed, position and data flow ensures synchronization between image forming system 300, substrate transport system 500 and blanket system 100 and ensures that the images are formed at the correct position on the blanket for proper positioning on the final substrate. The position of the blanket is monitored by means of markings on the surface of the blanket that are detected by multiple sensors 107 mounted at different positions along the length of the blanket. The output signals of these sensors are used to indicate the position of the image transfer surface to the print bars. Analysis of the output signals of the sensors 107 is further used to control the speed of the motors 160 and 162 to match that to the impression cylinders 502, 504.

As its length is a factor in synchronization, the blanket is required to resist stretching and creep. In the transverse direction, on the other hand, it is only required to maintain the blanket flat taut without creating excessive drag due to friction with the support plates 130. It is for this reason that, in an embodiment of the disclosure, the elasticity of the blanket is intentionally made anisotropic.

Blanket Pre-treatment

FIG. 1 shows schematically a roller 190 positioned externally to the blanket immediately before roller 106, according to an embodiment of the disclosure. Such a roller 190 may be used optionally to apply a thin film of pre-treatment solution containing a chemical agent, for example a dilute solution of a charged polymer, to the surface of the blanket. The film may be, totally dried by the time it reaches the print bars of the image forming system, to leave behind a very thin layer on the surface of the blanket that assists the ink droplets to retain their film-like shape after they have impacted the surface of the blanket.

While a roller can be used to apply an even film, in an alternative embodiment the pre-treatment or conditioning material is sprayed onto the surface of the blanket and spread more evenly, for example by the application of a jet from an air knife, a drizzle from sprinkles or undulations from a fountain. The pre-treatment solution may be removed from the transfer member shortly following its exposure thereto (e.g., by wiping or using an air flow). Independently of the method used to apply the optional conditioning solution, if needed, the location at which such pre-print treatment can be performed may be referred herein as the conditioning station.

The purpose of the applied chemical agent is to counteract the effect of the surface tension of the aqueous ink upon contact with the hydrophobic release layer of the blanket. It is believed that such pre-treatment chemical agents, for instance some charged polymers, such as polyethylenimine, will bond (temporarily at least), with the silicone surface of the transfer member to form a positively charged layer. However, the amount of charge that is present in such layer is believed to be much smaller than that in the droplet itself. The present inventors have found that a very thin layer, perhaps even a layer of molecular thickness will be adequate. This layer of pre-treatment of the transfer member may be applied in very dilute form of the suitable chemical agents. Ultimately this thin layer may be transferred onto the substrate, along with the image being impressed.

When the droplet impinges on the transfer member, the momentum in the droplet causes it to spread into a relatively flat volume. In the prior art, this flattening of the droplet is almost immediately counteracted by the combination of surface tension of the droplet and the hydrophobic nature of the surface of the transfer member.

In another embodiment, the shape of the ink droplet is "frozen" such that at least some of the flattening and horizontal extension of the droplet present on impact is preserved. It should be understood that since the recovery of the droplet shape after impact is very fast, the methods of the prior art would not effect phase change by agglomeration and/or coagulation and/or migration.

It is believed that, on impact, the positive charges on the transfer member attract the negatively charged polymer particles of the ink droplet that are immediately adjacent to the surface of the member. As the droplet spreads, this effect takes place along the entire interface between the spread droplet and the transfer member.

The amount of charge is too small to attract more than a small number of particles, so that, it is believed, the concentration and distribution of particles in the drop is not substantially changed. Furthermore, since the ink is aqueous, the effects of the positive charge are very local, especially in the very short time span needed for freezing the shape of the droplets.

While the applicants have found that coating the intermediate transfer member with a polymer utilizing a roller is an effective method for freezing the droplets, it is believed that spraying or otherwise chemically transferring positive charge to the intermediate transfer member is also possible, although this is a much more complex process.

In alternative embodiments of the invention, the tendency for the ink droplets to contract is counteracted by suitable selection of the chemical composition of one or other of the ink and the release layer on the blanket so as to establish attractive intermolecular forces that serve to resist the peeling away of the skin of the droplets from the surface of the release layer.

The average thickness of the elective pre-treatment solution may vary between initial application, optional removal and dried stage and is typically below 1000 nanometers, below 800 nm, below 600 nm, below 400 nm, below 200 nm, below 100 nm, below 50 nm, below 20 nm, below 10 nm, below 5 nm, or below 2 nm.

Ink Image Heating

The heaters 132 inserted into the support plates 130 are used to heat the blanket to a temperature that is appropriate for the rapid evaporation of the ink carrier and compatible with the composition of the blanket. For blankets comprising for instance silanol-, sylyl- or silane-modified or terminated polydialkylsiloxane silicones in the release layer, heating is typically of the order of 150° C., though this temperature may vary within a range from 120° C. to 180° C., depending on various factors such as the composition of the inks and/or of the conditioning solutions if needed. Blankets comprising amino silicones may generally be heated to temperatures between 70° C. and 130° C. When using the illustrated beneath heating of the transfer member, it is desirable for the blanket to have relatively high thermal capacity and low thermal conductivity, so that the temperature of the body of the blanket 102 will not change significantly as it moves between the optional pre-treatment or conditioning station, the image forming station and the impression station(s). To apply heat at different rates to the ink image carried by the transfer surface, external heaters or energy sources (not shown) may be used to apply additional energy locally, for example, prior to reaching the impression stations to render the ink residue tacky, prior to the image forming station to dry the conditioning agent if necessary and at the image forming station to start evaporating the carrier from the ink droplets as soon as possible after they impact the surface of the blanket.

The external heaters may be, for example, hot gas or air blowers 306 (as represented schematically in FIG. 1) or radiant heaters focusing, for example, infrared radiation onto the surface of the blanket, which may attain temperatures in excess of 175° C., 190° C., 200° C., 210° C., or even 220° C.

If the ink contains components sensitive to ultraviolet light then an ultraviolet source may be used to help cure the ink as it is being transported by the blanket.

Substrate Transport Systems

Figure 2:
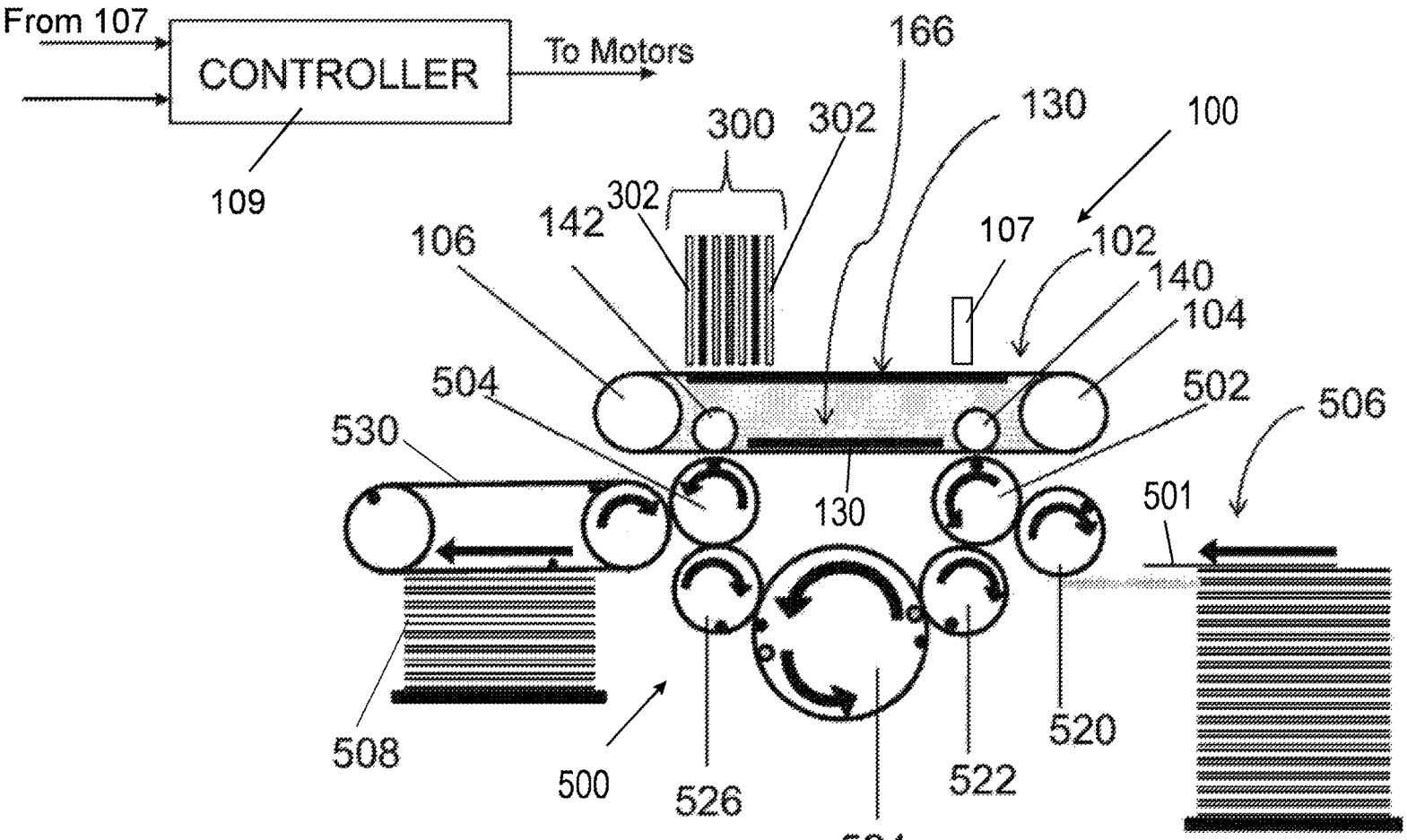
FIG. 2 is a schematic vertical section through the printer of FIG. 1, in which the various components of the printer are not drawn to scale.
Figure 5:
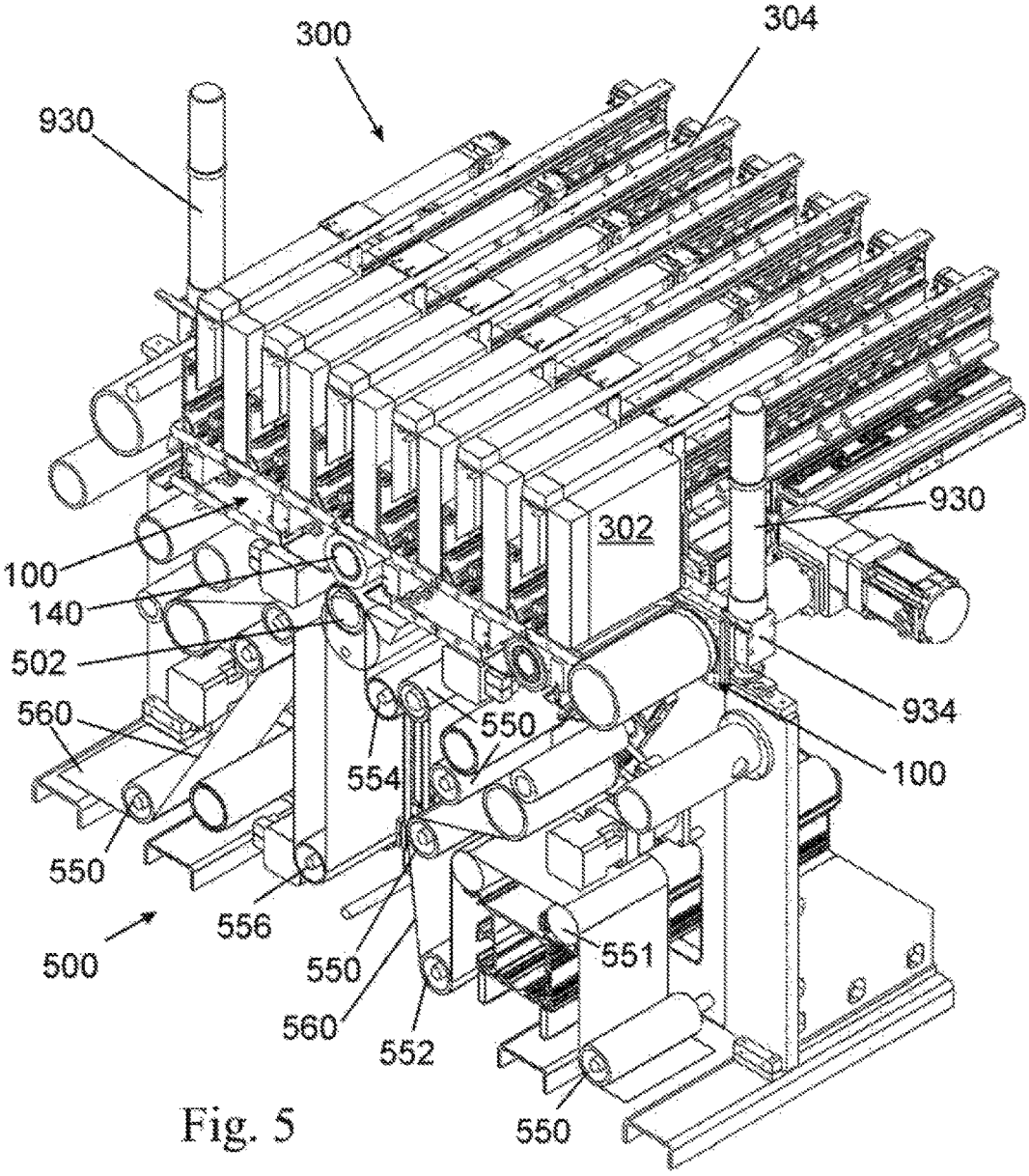
FIG. 5 is a schematic perspective view of a printer for printing on a continuous web of the substrate, in accordance with an embodiment of the disclosure.

The substrate transport may be designed as in the case of the embodiment of FIGS. 1 and 2 to transport individual sheets of substrate to the impression stations or, as is shown in FIG. 5, to transport a continuous web of the substrate.

In the case of FIGS. 1 and 2, individual sheets are advanced, for example by a reciprocating arm, from the top of an input stack 506 to a first transport roller 520 that feeds the sheet to the first impression cylinder 502.

Though not shown in the drawings, but known per se, the various transport rollers and impression cylinders may incorporate grippers that are cam operated to open and close at appropriate times in synchronism with their rotation so as to clamp the leading edge of each sheet of substrate. In an embodiment of the invention, the tips of the grippers at least of impression cylinders 502 and 504 are designed not to project beyond the outer surface of the cylinders to avoid damaging blanket 102.

After an image has been impressed onto one side of a substrate sheet during passage between impression cylinder 502 and blanket 102 applied thereupon by pressure roller 140, the sheet is fed by a transport roller 522 to a perfecting cylinder 524 that has a circumference that is twice as large as the impression cylinders 502, 504. The leading edge of the sheet is transported by the perfecting cylinder past a transport roller 526, of which the grippers are timed to catch the trailing edge of the sheet carried by the perfecting cylinder and to feed the sheet to second impression cylinder 504 to have a second image impressed onto its reverse side. The sheet, which has now had images printed onto both its sides, can be advanced by a belt conveyor 530 from second impression cylinder 504 to the output stack 508.

In further embodiments not illustrated in the figures, the printed sheets may be subjected to one or more finishing steps, either before being delivered to the output stack (inline finishing), or subsequent to such output delivery (offline finishing) or in combination when two or more finishing steps are performed. Such finishing steps include, but are not limited to laminating, gluing, sheeting, folding, glittering, foiling, protective and decorative coating, cutting, trimming, punching, embossing, debossing, perforating, creasing, stitching and binding of the printed sheets and two or more may be combined. As the finishing steps may be performed using suitable conventional equipment, or at least similar principles, their integration in the process and of the respective finishing stations in the systems of the invention will be clear to the person skilled in the art without the need for more detailed description.

As the images printed on the blanket are always spaced from one another by a distance corresponding to the circumference of the impression cylinders, the distance between the two impression cylinders 502 and 504 should also to be equal to the circumference of the impression cylinders 502, 504 or a multiple of this distance. The length of the individual images on the blanket is of course dependent on the size of the substrate not on the size of the impression cylinder.

In the embodiment shown in FIG. 5, a web 560 of the substrate is drawn from a supply roll (not shown) and passes over a number of guide rollers 550 with fixed axes and stationary cylinders 551 that guide the web past the single impression cylinder 502.

Some of the rollers over which the web 560 passes do not have fixed axes. In particular, on the in-feed side of the web 560, a roller 552 is provided that can move vertically. By virtue of its weight alone, or if desired with the assistance of a spring acting on its axle, roller 552 serves to maintain a constant tension in web 560. If, for any reason, the supply roller offers temporary resistance, roller 552 will rise and conversely roller 552 will move down automatically to take up slack in the web drawn from the supply roll.

At the impression cylinder, the web 560 is required to move at the same speed as the surface of the blanket. Unlike the embodiment described above, in which the position of the substrate sheets is fixed by the impression rollers, which assures that every sheet is printed when it reaches the impression rollers, if the web 560 were to be permanently engaged with blanket 102 at the impression cylinder 502, then much of the substrate lying between printed images would need to be wasted.

To mitigate this problem, there are provided, straddling the impression cylinder 502, two dancers 554 and 556 that are motorized and are moved up and down in opposite directions in synchronism with one another. After an image has been impressed on the web, pressure roller 140 is disengaged to allow the web 560 and the blanket to move relative to one another. Immediately after disengagement, the dancer 554 is moved downwards at the same time as the dancer 556 is moved up. Though the remainder of the web continues to move forward at its normal speed, the movement of the dancers 554 and 556 has the effect of moving a short length of the web 560 backwards through the gap between the impression cylinder 502 and the blanket 102 from which it is disengaged. This is done by taking up slack from the run of the web following impression cylinder 502 and transferring it to the run preceding the impression cylinder. The motion of the dancers is then reversed to return them to their illustrated position so that the section of the web at the impression cylinder is again accelerated up to the speed of the blanket. Pressure roller 140 can now be re-engaged to impress the next image on the web but without leaving large blank areas between the images printed on the web.

FIG. 5 shows a printer having only a single impression roller, for printing on only one side of a web. To print on both sides, a tandem system can be provided with two impression rollers, and a web inverter mechanism may be provided between the impression rollers to allow turning over of the web for double sided printing. Alternatively, if the width of the blanket exceeds twice the width of the web, it is possible to use the two halves of the same blanket and impression cylinder to print on the opposite sides of different sections of the web at the same time.

Figure 6:
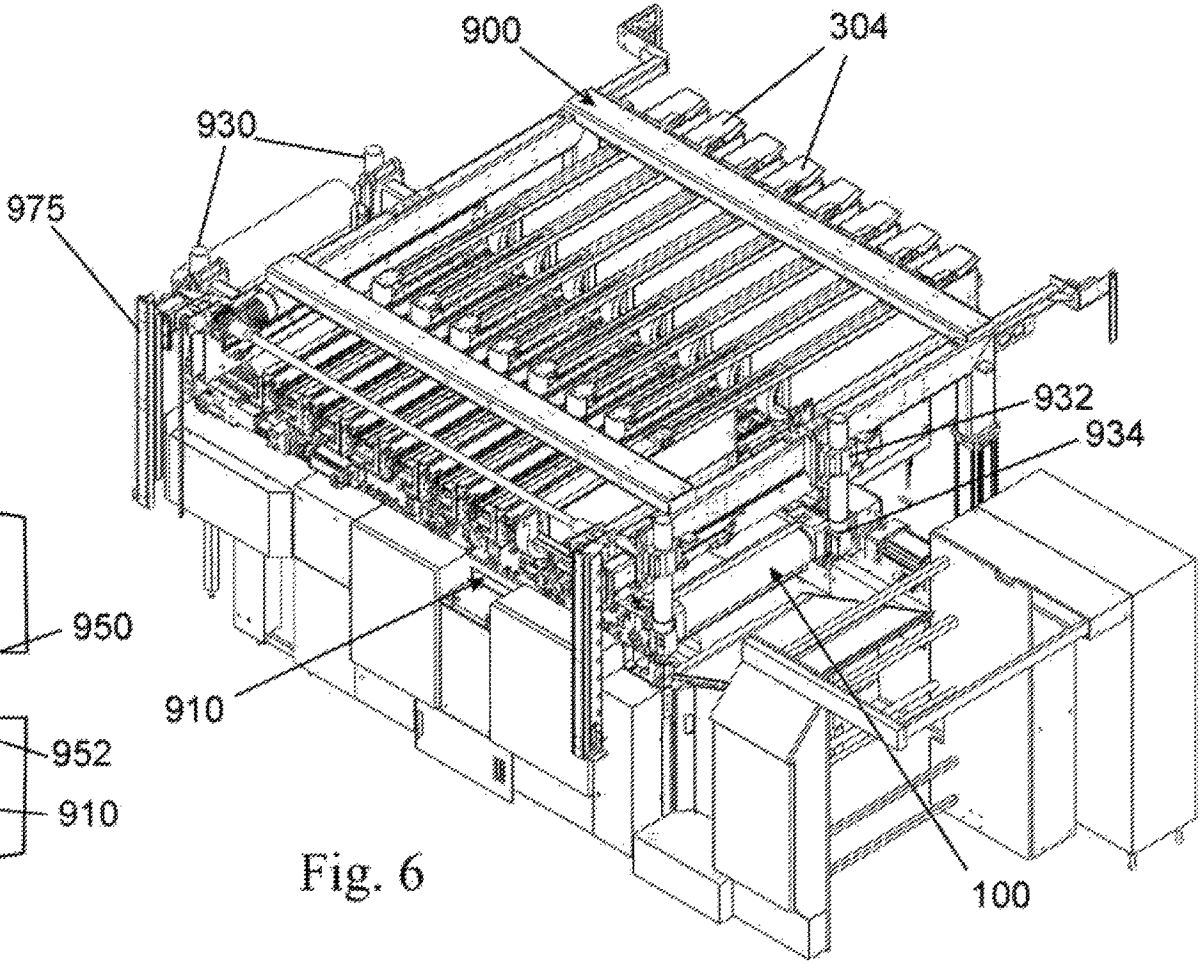
FIG. 6 is a perspective view of a printing system of FIG. 1 with a cover removed.
Figure 7:
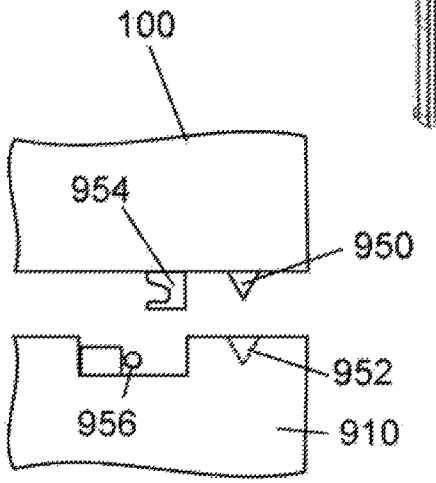
FIG. 7 is a schematic representation of a locking mechanism for the movable gantry in FIG. 6.
Figure 8:
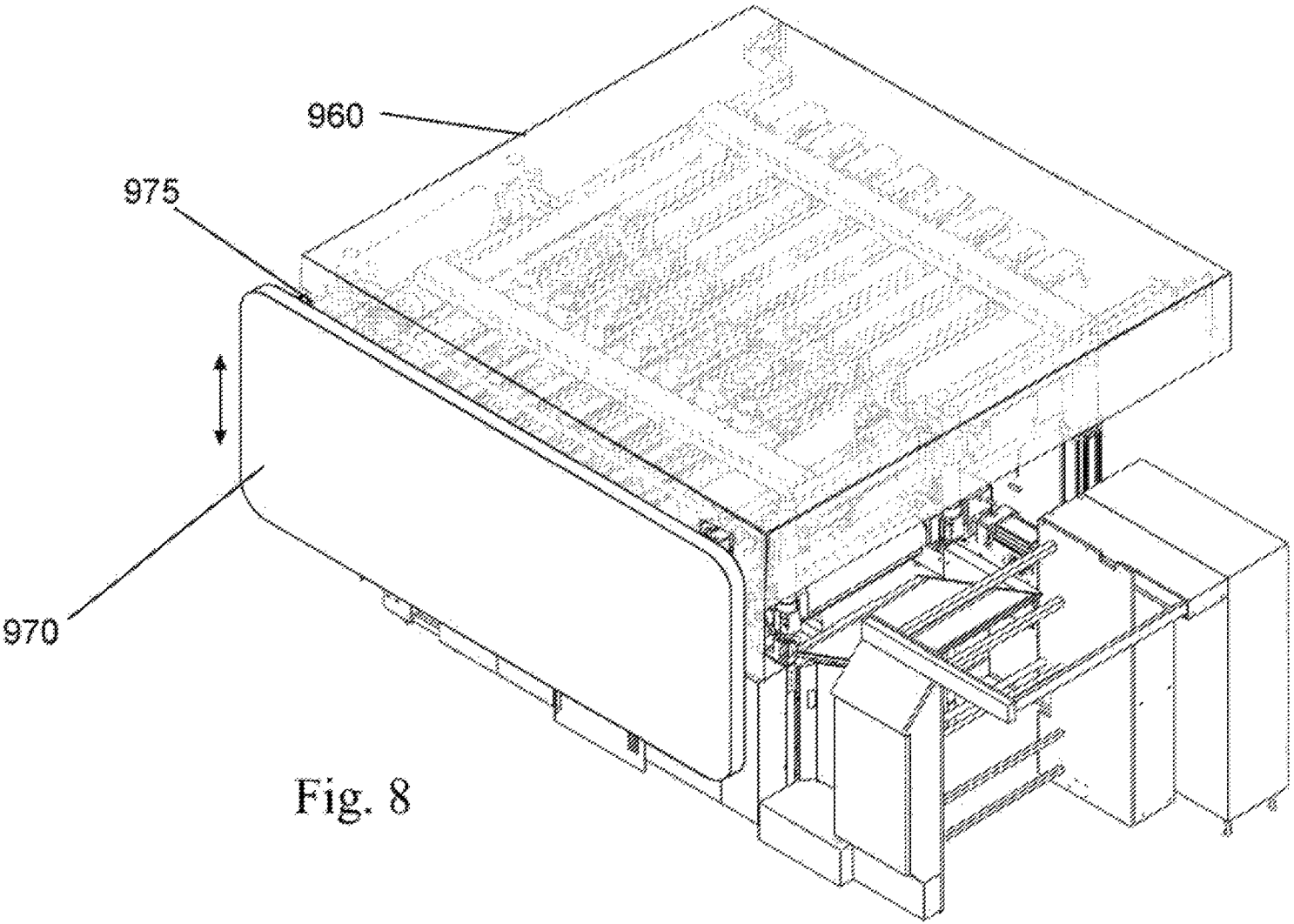
FIG. 8 is a schematic perspective view of a printing system with a cover and a display screen in place.

Referring now to FIGS. 6 to 8, in order to allow access to the various components of the printing system for maintenance, the image forming system 300 and the blanket system 100, are mounted on a common gantry 900, that is movable vertically relative to a base 910 that houses the substrate transport system 500, the gantry remaining horizontal and parallel to the impression cylinder(s) at all times as it is raised. The gantry 900 is a rigid structure to which the individual print bar frames 304 are secured. The print bar frames 304 overhang the base 910 of the printing system, the overhanging region being used to retain print bars that are not in current use. A motorized mechanism is provided within each frame 304 to move the associated print bar between its operative position overlying the blanket system 100 and the overhanging parked position.

The gantry 900 is supported on the base 910 of the printing system by means of hydraulic jacks 930 of which there are four, arranged one at each corner of the base 910. Each hydraulic jack 930 has a cylinder of which the upper end is secured to the gantry 900 by means of clamps 932 and a lower end secured to the blanket system 100 by means of clamps 934. The piston rod of each hydraulic jack 930 is movably secured to the base 910 of the printing system, a small degree of relative movement being provided to permit correct alignment of the blanket system 100 with the substrate transport system 500 when the printing system is in operation.

The piston rod of each jack is hollow and a coupling is provided at its lower end to permit hydraulic fluid to be introduced into, and drained from, the working chamber of the hydraulic jack. Because the hydraulic coupling is connected to a part of the printing system that is stationary, there is no need to resort to flexible pipes in the hydraulic circuit of the jacks 930.

Because the gantry 900 overhangs the base 910 of the printing system, its center of gravity does not lie symmetrically between the lifting jacks 930. In order to withstand the tendency of the gantry to tilt as it is being lowered and raised, it is possible to make the hydraulic jacks 930 of unequal hydraulic capacity. For example, in FIG. 6, if the hydraulic jacks 930 on the right of the base 910 are formed with a larger diameter working chamber than the hydraulic jacks on the left then the center of lift can be shifted to the right into closer alignment with the center of gravity of the gantry 900. The illustrated embodiment, however, resorts to additional hydraulic jacks which extend from the overhanging region of the gantry 900 to the ground.

In the operating position of the blanket system 100, it needs to be in correct alignment with the substrate transport system 500 and clamped to it. This may be achieved in the manner shown schematically in FIG. 7 which shows a locking mechanism similar to that used to lock together the halves of a mold of an injection molding machine. The alignment is achieved by means of a cone 950 on the blanket system 100 that is received within a conical depression 952 in the base 910. The conical angle of the cone 950 and the depression 952 are relatively large (greater than 5°) to avoid the risk of taper lock. Locking is achieved by a hydraulically or mechanically retractable tongue 956 that engages in a lateral notch in a catch 954 secured to the blanket system 100. The shape of the notch in the catch 954 defines an over center position for the tongue 956 to enable the blanket system to withstand the pressure applied at the nip that compresses the substrate against the blanket.

The printing systems in FIGS. 5 and 6 are shown with the blanket system 100 lowered into the position in which it contacts the substrate transport system 500. In this position images can be impressed on a substrate and the correct spacing is achieved between the blanket system 100 and the image forming system 300 for an ink image to be laid down accurately on the blanket. While in operation, a cover 960, shown as being semi-transparent in FIG. 8, encloses the image forming system 300 and blanket system 100, the cover being secured to the gantry 900 so as move up and down relative to the base 910 as the gantry 900 is raised and lowered.

The gantry 900 further slidably supports a display screen 970 that lies on the front of the printing system and is substantially as wide as the blanket system, or at least greater than one half of its width. This large area display screen 970 is used to display information to the operator and it may also be designed as a touch screen to enable the operator to input commands into the printing system. Rails 975 that slidably support the display screen 970 are mounted directly on the gantry 900 as shown in FIG. 6. Though the rails 975 are illustrated in this figure as having vertical orientation, thereby allowing the display screen to slide up and down so as either to block or to provide access to the inner parts of the printing system, the rails may instead be horizontal. Further details of suitable mounting of display screens and of method of use of display devices in connection with printing systems such as the herein disclosed are provided in co-pending PCT application No. PCT/IB2013/050245 (Agent's reference LIP 15/001 PCT).

Image Forming System

As best shown in FIG. 5, the image forming system 300 comprises print bars 302 each slidably mounted on a frame 304 positioned at a fixed height above the surface of the blanket 102. Each print bar 302 may comprise a strip of print heads as wide as the printing area on the blanket 102 and comprises individually controllable print nozzles. The image forming system can have any number of bars 302, each of which may contain an aqueous ink of a different color.

As some print bars may not be required during a particular printing job, the heads can be moved between an operative position, in which they overlie blanket 102 and an inoperative position. A mechanism is provided for moving print bars 302 between their operative and inoperative positions but the mechanism is not illustrated and need not be described herein, as it is not relevant to the printing process. It should be noted that the bars remain stationary during printing.

When moved to their inoperative position, the print bars are covered for protection and to prevent the nozzles of the print bar from drying or clogging. In one embodiment, the print bars are parked above a liquid bath (not shown) that assists in this task. In another embodiment, the print heads are cleaned, for example by removing residual ink deposit that may form surrounding the nozzle rims. Such maintenance of the print heads can be achieved by any suitable method, ranging from contact wiping of the nozzle plate to distant spraying of a cleaning solution toward the nozzles and elimination of the cleansed ink deposits by positive or negative air pressure. Print bars that are in the inoperative position can be changed and accessed readily for maintenance, even while a printing job is in progress using other print bars. Within each print bar, the ink may be constantly recirculated, filtered, degassed and maintained at a desired temperature and pressure. As the design of the print bars may be conventional, or at least similar to print bars used in other inkjet printing applications, their construction and operation will be clear to the person skilled in the art without the need for more detailed description.

As different print bars 302 are spaced from one another along the length of the blanket, it is of course essential for their operation to be correctly synchronized with the movement of blanket 102.

If desired, as will be described below in connection with the embodiment of the disclosure shown in FIG. 9, it is possible to provide a blower following each print bar 302 to blow a slow stream of a hot gas (for example air) over the intermediate transfer member to commence the drying of the ink droplets deposited by the print bar 302. This assists in fixing the droplets deposited by each print bar 302, that is to say resisting their contraction and preventing their movement on the intermediate transfer member, and also in preventing them from merging into droplets deposited subsequently by other print bars 302.

Advantages Offered by the Process of the Invention

The described and illustrated embodiments of the invention provide several advantages both in terms of the process itself and the quality of the end product.

The aqueous ink compositions render the printing process more environmentally friendly.

Freezing the ink droplets impacting the intermediate transfer member enable formation of dried color dots that are thinner than those resulting from previously used printing processes or techniques, being typically no more than 500 nm or 600 nm or 700 nm or 800 nm in thickness. Aside from using less ink, the film is so thin that it closely follows the contours of the surface of the substrate and does not change its surface texture. Thus printing on a glossy substrate will produce a glossy image and when printing on a matte substrate the print areas will not be substantially glossier than non-print areas.

When each ink drop is flattened into a film, because it rests on a hydrophobic surface which is not solvated by the liquid in the image, surface tension will act to impart a smooth outline to the droplet. That sharp regular outline is retained as the droplet is dried, and is reflected in the shape of the ink dots of the printed image on the substrate. Furthermore, the flattened shape has a more uniform color than dried color elements that are formed from droplets with a less uniform thickness.

When this is combined with the film forming characteristic of the polymer in the ink, the ink droplets and their uniform thinness provides a more ideal vehicle for forming high quality, high resolution images.

The combination of an aqueous ink and a hydrophobic release layer ensures that the surface of the blanket does not absorb any of the carrier. By contrast, in certain prior art processes, such absorption causes swelling of the blanket and distortion of its surface, which in turn imparts a textured or rough surface to the ink residue, detracting from the quality of the final printed image.

This is to be contrasted with the situation where each ink droplet wets the surface on which it lands, as for example, for colorants with organic carriers that utilize a hydrophobic transfer member or for transfer members that absorb the liquid or are hydrophilic and used in combination with aqueous inks. Such undesired excessive wetting causes the droplet to spread further into any irregularities that exist in the surface of the transfer member (and may cause such irregularities to form), with the result that each ink dot in the printed image is spidery, with tentacles and rivulets greatly increasing its perimeter as compared with that of a well-rounded dot of the same area. The thickness of the film in such tentacles is necessarily thinner than at the center of each dot and the combination of these effects is to produce a blurred and ill-defined ink dot.

The film created by each droplet is impressed more reliably onto the substrate than a thicker layer of softened residue, as the risk of the layer splitting into two and part of it remaining on the blanket is reduced.

In general, ink jets printers require a trade-off between purity of the color, the ability to produce complete coverage of a surface and the density of the inkjet nozzles. If the dot created by each ink droplet is small, then, in order to obtain complete coverage, it is necessary to have closely spaced inkjet nozzles. In the process of the invention, to achieve full coverage, the separation of the inkjet nozzles need only be comparable with the size of the largest image dot that can be created by an ink droplet after it has been flattened by impacting the surface of the transfer member or at least after its size stabilizes.

Since the ink dots are distinct and adopt their final form in a very short time, the amount of bleeding between colors and interaction between droplets of the same color is reduced.

Figure 9:
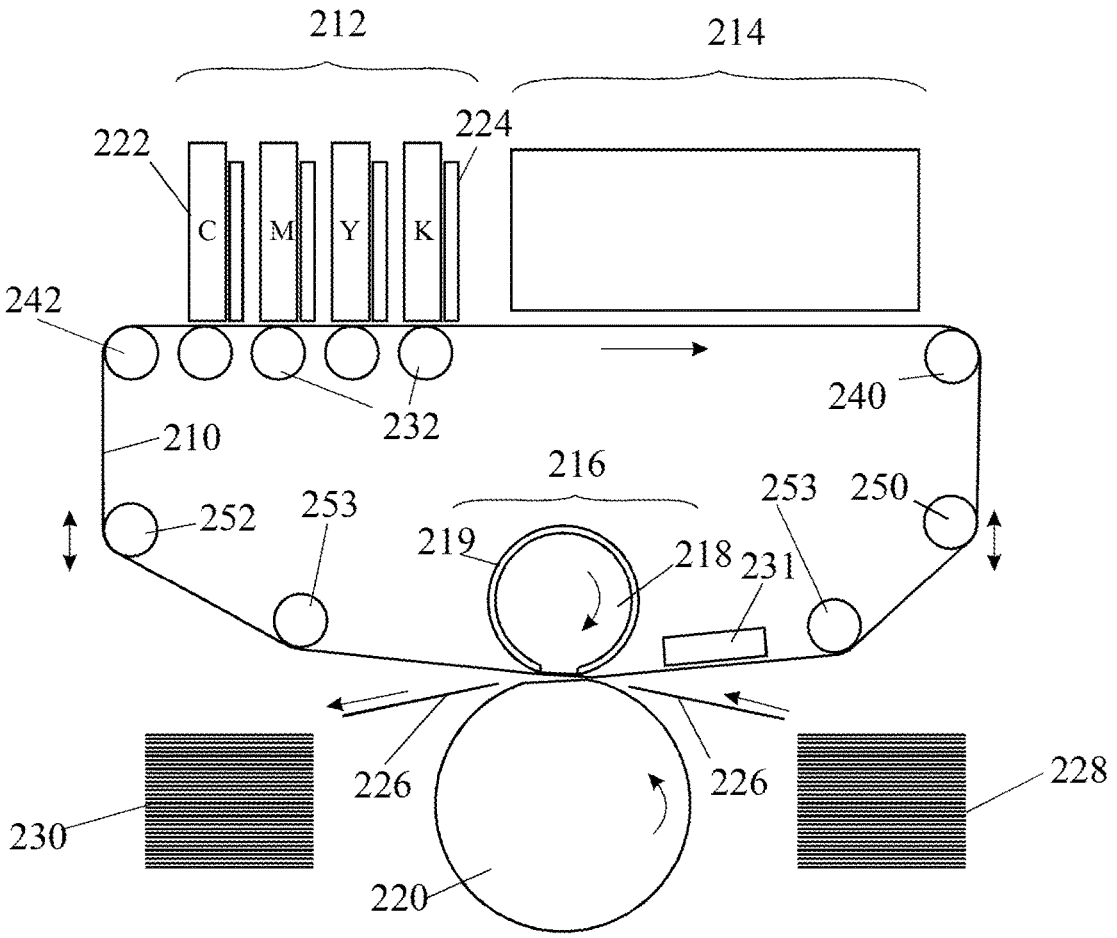
FIG. 9 is a schematic representation of a printing system in accordance with a second embodiment of the disclosure.
Figure 10:
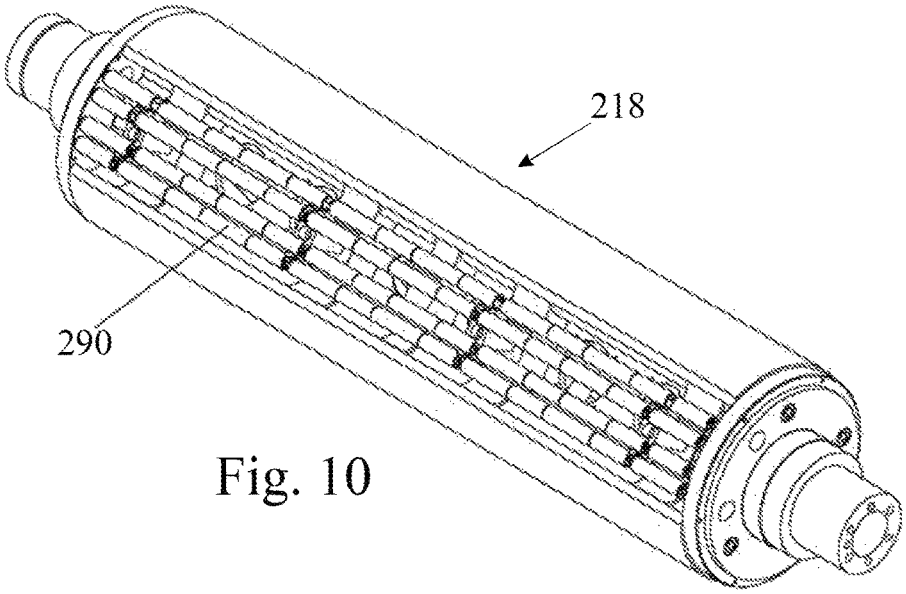
FIG. 10 is a perspective view of a pressure cylinder as used in the embodiment of FIG. 9 having rollers within the discontinuity between the ends of the blanket.

A printing system for printing on substrate sheets is shown in FIG. 9 which operates on the same principle as that of FIG. 1 but has an alternative architecture. The printing system of FIG. 9 comprises an endless belt 210 that cycles through an image forming station 212, a drying station 214, and an impression station 216. The image forming station 212 of FIG. 9 is similar to the previously described image forming system 300, illustrated for example in FIG. 1.

In the image forming station 212 four separate print bars 222 incorporating one or more print heads, that use inkjet technology, deposit aqueous ink droplets of different colors onto the surface of the belt 210. Though the illustrated embodiment has four print bars, each able to deposit one of the typical four different colors (namely Cyan (C), Magenta (M), Yellow (Y) and Black (K)), it is possible for the image forming station to have a different number of print bars and for the print bars to deposit different shades of the same color (e.g., various shades of gray including black) or for two print bars or more to deposit the same color (e.g., black). In a further embodiment, the print bar can be used for pigmentless liquids (e.g., decorative or protective varnishes) and/or for specialty colors (e.g., achieving visual effect, such as metallic, sparkling, glowing, or glittering look or even scented effect). Following each print bar 222 in the image forming station, an intermediate drying system 224 is provided to blow hot gas (usually air) onto the surface of the belt 210 to dry the ink droplets partially. This hot gas flow assists in preventing blockage of the inkjet nozzles and also prevents the droplets of different color inks on the belt 210 from merging into one another. In the drying station 214, the ink droplets on the belt 210 are exposed to radiation and/or hot gas in order to dry the ink more thoroughly, driving off most, if not all, of the liquid carrier and leaving behind only a layer of resin and coloring agent which is heated to the point of being rendered tacky.

In the impression station 216, the belt 210 passes between an impression cylinder 220 and a pressure cylinder 218 that carries a compressible blanket 219. The length of the blanket 219 is equal to or greater than the maximum length of a sheet 226 of substrate on which printing is to take place. The impression cylinder 220 may have twice the diameter of the pressure cylinder 218 and can support two sheets 226 of substrate at the same time. Sheets 226 of substrate are carried by a suitable transport mechanism (not shown in FIG. 9) from a supply stack 228 and passed through the nip between the impression cylinder 220 and the pressure cylinder 218. Within the nip, the surface of the belt 220 carrying the ink image is pressed firmly by the blanket 219 of the pressure cylinder 218 against the substrate so that the ink image is impressed onto the substrate and separated neatly from the surface of the belt. The substrate is then transported to an output stack 230.

In some embodiments, a heater 231 may be provided shortly prior to the nip between the two cylinders 218 and 220 of the image impression station to assist in rendering the ink film tacky, so as to facilitate transfer to the substrate.

As the optimum temperature of the belt 210 at the different stations is not necessarily the same, as well as provided heaters along its path, it is possible to provide means for cooling the belt, for example by blowing cold air or applying a cooling liquid onto its surface. In embodiments of the invention in which a treatment solution is applied to the surface of the belt, the treatment station may serve as a cooling station.

A particularly advantageous manner of applying the treatment solution is to direct a spray of the solution onto the surface of the belt and then to use an air knife to remove most, if not all, of the applied solution to leave only a coating of molecular thickness. In this case, both the spraying of the treatment solution and the removal of the surplus liquid would have a cooling effect on the surface of the belt.

The above description of the embodiment of FIG. 9 is simplified and provided only for the purpose of enabling an understanding of the present invention. For a successful printing system, the physical and chemical properties of the inks, the chemical composition and possible treatment of the release surface of the belt 210, and the control of the various stations of the printing system, are all important but need not be considered in detail in the present context.

In order for the ink to separate neatly from the surface of the belt 210 it is necessary for the latter surface to have a hydrophobic release layer. In the embodiment of FIG. 1, this hydrophobic release layer is formed as part of a thick blanket that also includes a compressible conformability layer which is necessary to ensure proper contact between the release layer and the substrate at the impression station. The resulting blanket is a very heavy and costly item that needs to be replaced in the event a failure of any of the many functions that it fulfills.

In the embodiment of FIG. 9, the hydrophobic release layer forms part of a separate element from the thick blanket 219 that is needed to press it against the substrate sheets 226. In FIG. 9, the release layer is formed on the flexible thin inextensible belt 210 that may be fiber reinforced for increased tensile strength in its lengthwise dimension. The printing system of FIG. 9, which is described in greater detail in co-pending patent application PCT/IB2013/051718 (Agent's reference LIP 5/006 PCT) comprises an endless belt 210 that cycles through an image forming station 212, a drying station 214, and an impression station 216.

Figure 11:
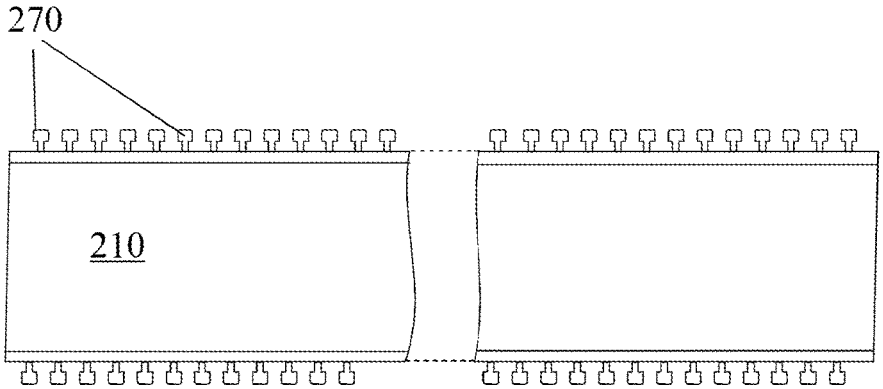
FIG. 11 is a plan view of a strip from which a belt is formed, the strip having teeth along its edges to assist in guiding the belt.
Figure 12:
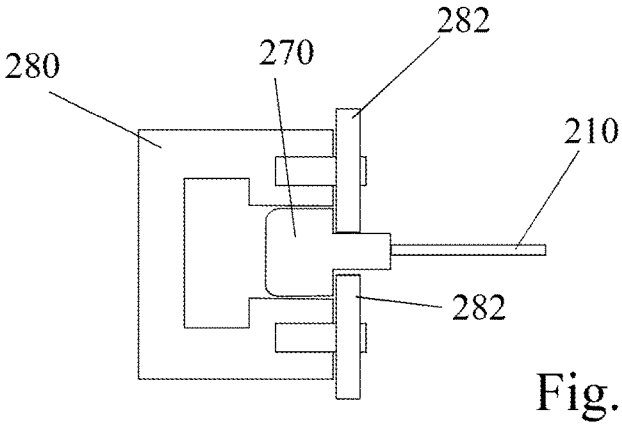
FIG. 12 is a section through a guide within which the teeth of the belt shown in FIG. 11 are received.

As shown schematically in FIGS. 11 and 12, the lateral edges of the belt 210 are provided in some embodiments of the disclosure with spaced formations or projections 270 which on each side are received in a respective guide channel 280 (shown in section in FIG. 12 and as track 180 in FIGS. 3-4) in order to maintain the belt taut in its width ways dimension. The projections 270 may be the teeth of one half of a zip fastener that is sewn or otherwise secured to the lateral edge of the belt. As an alternative to spaced projections, a continuous flexible bead of greater thickness than the belt 210 may be provided along each side. To reduce friction, the guide channel 280 may, as shown in FIG. 12, have rolling bearing elements 282 to retain the projections 270 or the beads within the channel 280.

The projections may be made of any material able to sustain the operating conditions of the printing system, including the rapid motion of the belt. Suitable materials can resist elevated temperatures in the range of about 50° C. to 250° C. Advantageously, such materials are also friction resistant and do not yield debris of size and/or amount that would negatively affect the movement of the belt during its operative lifespan. For example, the lateral projections can be made of polyamide reinforced with molybdenum disulfide.

Guide channels in the image forming station ensure accurate placement of the ink droplets on the belt 210. In other areas, such as within the drying station 214 and the impression station 216, lateral guide channels are desirable but less important. In regions where the belt 210 has slack, no guide channels are present.

All the steps taken to guide the belt 210 are equally applicable to the guiding of the blanket 102 in the embodiments of FIGS. 1 to 8, where the guide channel 280 was also referred to as track 180.

It is important for the belt 210 to move with constant speed through the image forming station 212 as any hesitation or vibration will affect the registration of the ink droplets of different colors. To assist in guiding the belt smoothly, friction is reduced by passing the belt over rollers 232 adjacent each print bar 222 instead of sliding the belt over stationary guide plates. The rollers 232 need not be precisely aligned with their respective print bars. They may be located slightly (e.g., few millimeters) downstream of the print head jetting location. The frictional forces maintain the belt taut and substantially parallel to print bars. The underside of the belt may therefore have high frictional properties as it is only ever in rolling contact with all the surfaces on which it is guided. The lateral tension applied by the guide channels need only be sufficient to maintain the belt 210 flat and in contact with rollers 232 as it passes beneath the print bars 222. Aside from the inextensible reinforcement/support layer, the hydrophobic release surface layer and high friction underside, the belt 210 is not required to serve any other function. It may therefore be a thin light inexpensive belt that is easy to remove and replace, should it become worn.

To achieve intimate contact between the hydrophobic release layer and the substrate, the belt 210 passes through the impression station 216 which comprises the impression and pressure cylinders 220 and 218. The replaceable blanket 219, releasably clamped onto the outer surface of the pressure cylinder 218, provides the conformability required to urge the release layer of the belt 210 into contact with the substrate sheets 226. Rollers 253 on each side of the impression station ensure that the belt is maintained in a desired orientation as it passes through the nip between the cylinders 218 and 220 of the impression station 216.

As explained above, temperature control is of paramount importance to the printing system if printed images of high quality are to be achieved. This is considerably simplified in the embodiment of FIG. 9 in that the thermal capacity of the belt is much lower than that of the blanket 102 in the embodiments of FIGS. 1 to 8.

It has also been proposed above in relation to the embodiment using a thick blanket 102 to include additional layers affecting the thermal capacity of the blanket in view of the blanket being heated from beneath. The separation of the belt 210 from the blanket 219 in the embodiment of FIG. 9 allows the temperature of the ink droplets to be dried and heated to the softening temperature of the resin using much less energy in the drying section 214. Furthermore, the belt may cool down before it returns to the image forming station which reduces or avoids problems caused by trying to spray ink droplets on a hot surface running very close to the inkjet nozzles. Alternatively and additionally, a cooling station may be added to the printing system to reduce the temperature of the belt to a desired value before the belt enters the image forming station. Cooling may be effected by passing the belt 210 over a roller of which the lower half is immersed in a coolant, which may be water or a cleaning/treatment solution, by spraying a coolant onto the belt of by passing the belt 210 over a coolant fountain.

Though, as explained, the temperature at various stages of the process may vary depending on the exact composition of the intermediate transfer member and inks being used, and may even fluctuate at various locations along a given station, in some embodiments of the disclosure the temperature on the outer surface of the transfer member at the image forming station is in a range between 40° C. and 160° C., or between 60° C. and 90° C. In some embodiments of the disclosure, the temperature at the dryer station is in a range between 90° C. and 300° C., or between 150° C. and 250° C., or between 200° C. and 225° C. In some embodiments, the temperature at the impression station is in a range between 80° C. and 220° C., or between 100° C. and 160° C., or of about 120° C., or of about 150° C. If a cooling station is desired to allow the transfer member to enter the image forming station at a temperature that would be compatible to the operative range of such station, the cooling temperature may be in a range between 40° C. and 90° C.

In some embodiments of the disclosure, the release layer of the belt 210 has hydrophobic properties to ensure that the tacky ink residue image peels away from it cleanly in the impression station. However, at the image forming station, the same hydrophobic properties are undesirable because aqueous ink droplets can move around on a hydrophobic surface and, instead of flattening on impact to form droplets having a diameter that increases with the mass of ink in each droplet, the ink tends to ball up into spherical globules. In embodiments with a release layer having a hydrophobic outer surface, steps therefore need to be taken to encourage the ink droplets first to flatten out into a disc on impact then to retain their flattened shape during the drying and transfer stages.

To achieve this objective, in some embodiments of the disclosure, it is desirable for the liquid ink to comprise a component chargeable by Brønsted-Lowry proton transfer, to allow the liquid ink droplets to acquire a charge subsequent to contact with the outer surface of the belt by proton transfer so as to generate an electrostatic interaction between the charged liquid ink droplets and an opposite charge on the outer surface of the belt. Such an electrostatic charge will fix the droplets to the outer surface of the belt and resist the formation of spherical globule.

The Van der Waals forces resulting from the Brønsted-Lowry proton transfer may result either from an interaction of the ink with a component forming part of the chemical composition of the release layer, such as amino silicones, or with a treatment solution, such as a high charge density PEI, that is applied to the surface of the belt 210 prior to its reaching the image forming station 212 (e.g., if the belt to be treated has a release layer comprising silanol-terminated polydialkylsiloxane silicones).

Without wishing to be bound by a particular theory, it is believed that upon evaporation of the ink carrier, the reduction of the aqueous environment lessens the respective protonation of the ink component and of the release layer or treatment solution thereof, thus diminishing the electrostatic interactions therebetween allowing the dried ink image to peel off from the belt upon transfer to substrate.

It is possible for the belt 210 to be seamless, that is it to say without discontinuities anywhere along its length. Such a belt would considerably simplify the control of the printing system as it may be operated at all times to run at the same surface velocity as the circumferential velocity of the two cylinders 218 and 220 of the impression station. Any stretching of the belt with ageing would not affect the performance of the printing system and would merely require the taking up of more slack by tensioning rollers 250 and 252, detailed below.

It is however less costly to form the belt as an initially flat strip of which the opposite ends are secured to one another, for example, by a zip fastener, or possibly by a strip of hook and loop tape, or possibly by soldering the edges together, or possibly by using tape (e.g., Kapton® tape, RTV liquid adhesives, or PTFE thermoplastic adhesives with a connective strip overlapping both edges of the strip). In such a construction of the belt, it is essential to ensure that printing does not take place on the seam and that the seam is not flattened against the substrate 226 in the impression station 216.

The impression and pressure cylinders 218 and 220 of the impression station 216 may be constructed in the same manner as the blanket and impression cylinders of a conventional offset litho press. In such cylinders, there is a circumferential discontinuity in the surface of the pressure cylinder 218 in the region where the two ends of the blanket 219 are clamped. There are also discontinuities in the surface of the impression cylinder which accommodate grippers that serve to grip the leading edges of the substrate sheets to help transport them through the nip. In the illustrated embodiments of the disclosure, the impression cylinder circumference is twice that of the pressure cylinder and the impression cylinder has two sets of grippers, so that the discontinuities line up twice every cycle for the impression cylinder.

If the belt 210 has a seam, then it is necessary to ensure that the seam always coincides in time with the gap between the cylinders of the impression station 216. For this reason, it is desirable for the length of the belt 210 to be equal to a whole number multiple of the circumference of the pressure cylinder 218.

However, even if the belt has such a length when new, its length may change during use, for example with fatigue or temperature, and should that occur, the phase of the seam during its passage through the nip will change every cycle.

To compensate for such change in the length of the belt 210, it may be driven at a slightly different speed from the cylinders of the impression station 216. The belt 210 is driven by two separately powered rollers 240 and 242. By applying different torques through the rollers 240 and 242 driving the belt, the run of the belt passing through the image forming station is maintained under controlled tension. The speed of the two rollers 240 and 242 can be set to be different from the surface velocity of the cylinders 218 and 220 of the impression station 216. Alternatively or additionally, the belt may be driven or moved by supporting surfaces that need not be cylindrical. For instance, instead of a rotating roller, the supporting surface may be planar and operative to cause a linear displacement of part of the belt. Independently of shape and type of movement generated on the supported portion of the belt, such guiding or driving means may be referred to collectively as supporting surfaces.

Two powered tensioning rollers, or dancers, 250 and 252 are provided one on each side of the nip between the cylinders of the impression station. These two dancers 250, 252 are used to control the length of slack in the belt 210 before and after the nip and their movement is schematically represented by double sided arrows adjacent the respective dancers.

If the belt 210 is slightly longer than a whole number multiple of the circumference of the pressure cylinder, then if in one cycle the seam does align with the enlarged gap between the cylinders 218 and 220 of the impression station then in the next cycle the seam will have moved to the right, as viewed in FIG. 1. To compensate for this, the belt is driven faster by the rollers 240 and 242 so that slack builds up to the right of the nip and tension builds up to the left of the nip. To maintain the belt 210 at the correct tension, the dancer 250 is moved down and at the same time the dancer 252 is moved up. When the discontinuities of the cylinders of the impression station face one another and a gap is created between them, the dancer 252 is moved down and the dancer 250 is moved up to accelerate the run of the belt passing through the nip and bring the seam into the gap.

To reduce the drag on the belt 210 as it is accelerated through the nip, the pressure cylinder 218 may, as shown in FIG. 5, be provided with rollers 290 within the discontinuity region between the ends of the blanket.

The need to correct the phase of the belt in this manner may be sensed either by measuring the length of the belt 210 or by monitoring the phase of one or more markers on the belt relative to the phase of the cylinders of the impression station. The marker(s) may, for example, be applied to the surface of the belt that may be sensed magnetically or optically by a suitable detector. Alternatively, a marker may take the form of an irregularity in the lateral projections that are used to tension the belt and maintain it under tension, for example, a missing tooth, hence serving as a mechanical position indicator.

It is further possible to incorporate into the belt an electronic circuit, for example a microchip similar to those to be found in "chip and pin" credit cards, in which data may be stored. The microchip may comprise only read only memory, in which case it may be used by the manufacturer to record such data as where and when the belt was manufactured and details of the physical or chemical properties of the belt. The data may relate to a catalog number, a batch number, and any other identifier allowing providing information of relevance to the use of the belt and/or to its user. This data may be read by the controller of the printing system during installation or during operation and used, for example, to determine calibration parameters. Alternatively, or additionally, the chip may include random access memory to enable data to be recorded by the controller of the printing system on the microchip. In this case, the data may include information such as the number of pages or length of web that have been printed using the belt or previously measured belt parameters such as belt length, to assist in recalibrating the printing system when commencing a new print run. Reading and writing on the microchip may be achieved by making direct electrical contact with terminals of the microchip, in which case contact conductors may be provided on the surface of the belt. Alternatively, data may be read from the microchip using radio signals, in which case the microchip may be powered by an inductive loop printed on the surface of the belt.

The printing system shown in FIG. 9 is intended for printing on individual substrate sheets. It is possible to use a similar system to print on a continuous web and in this case, the pressure cylinder may, instead of having a blanket wrapped around part of its circumference, have a compressible continuous outer surface. Furthermore, no grippers need be incorporated in the impression cylinder.

Further details of monitoring methods suitable for printing systems such as the herein disclosed are provided in co-pending PCT application No. PCT/IB2013/051727 (Agent's reference LIP 14/001 PCT).

A further important advantage of printing systems of embodiments of the disclosure is that they may be produced by modification to existing lithographic printing presses. The ability to adapt existing equipment, while retaining much of the hardware already present, considerably reduces the investment required to convert from technology in common current use. In particular, in the case of the embodiment of FIG. 1, the modification of a tower would involve replacement of the plate cylinder by a set of print bars and replacement of the pressure cylinder by an image transfer drum having a hydrophobic outer surface or carrying a suitable blanket. In the case of the embodiment of FIG. 9, the plate cylinder would be replaced by a set of print bars and a belt passing between the existing plate and pressure cylinders. The substrate handling system would require little modification, if any. Color printing presses are usually formed of several towers and it is possible to convert all or only some of the towers to digital printing towers. Various configurations are possible offering different advantages. For example each of two consecutive towers may be configured as a multicolor digital printer to allow duplex printing if a perfecting cylinder is disposed between them. Alternatively, multiple print bars of the same color may be provided on one tower to allow an increased speed of the entire press.

Consistent with the present disclosure, a formulation is provided for use with an intermediate transfer member of a printing system. The formulation may comprise (a) a carrier liquid; (b) a positively chargeable polymeric chemical agent selected from the group consisting of polyethylene imine (PEI), a cationic guar or guar-based polymer and a cationic methacrylamide or methacrylamide-based polymer; and (c) a resolubilizing agent selected to improve resolubilization of the chemical agent; the polymeric chemical agent and the resolubilizing agent being disposed within the carrier liquid; the polymeric chemical agent having an average molecular weight of at least 10,000 and a positive charge density of at least 0.1 meq/g of the chemical agent; the resolubilizing agent having, in a pure state and at 90° C., a vapor pressure of less than 0.5 kPa; and the weight ratio of the resolubilizing agent to the polymeric chemical agent, within the formulation, being at least 1:10.

In some embodiments, the resolubilizing agent of the formulation herein disclosed may have a hydrogen-bonding functional group. In some embodiments, a functional group density of the hydrogen-bonding functional group within the resolubilizing agent is at least 0.25 meq/g, at least 0.35 meq/g, at least 0.45 meq/g, at least 0.6 meq/g, at least 0.8 meq/g, at least 1 meq/g, at least 2 meq/g, at least 3 meq/g, at least 5 meq/g, at least 7 meq/g, at least 10 meq/g, at least 15 meq/g, at least 20 meq/g, at least 22 meq/g, at least 24 meq/g, at least 26 meq/g, at least 28 meq/g, or at least 30 meq/g.

In some embodiments, the resolubilizing agent may have at least one functional group selected from a hydroxyl group, an amine group, an ether group, a sulfonate group, and combinations thereof.

In some embodiments, the resolubilizing agent is selected from the group including diols, triols, polyols, alcohols, sugars and modified sugars, ethers, polyethers, amino alcohol, amino silicones, styrene sulfonates, and combinations thereof. In some embodiments, the resolubilizing agent is selected from the group consisting of cocoamide diethanol amine, ethoxylated methyl glucose ether, Glucam™ E-10, Glucam™ E-20, glycerol, pentaerythritol, PEG 400, PEG 600, poly(sodium-4-styrenesulfonate), SilSense® Q-Plus Silicone, SilSense® A21 Silicone, sucrose, triethanol amine, and triethylene glycol monomethyl ether. In some embodiments, the resolubilizing agent may have a molecular weight below 5,000, below 2,500, below 1,000, below 750, below 600, below 500, below 400, below 350, or below 300.

In some embodiments, the resolubilizing agent of the formulation herein disclosed may have a solubility, in the formulation, of at least 1%, at least 3%, at least 5%, at least 10%, at least 20%, at least 30%, at least 40%, at least 50% at 25° C. In some embodiments, the chemical agent, the resolubilizing agent, and the carrier liquid make up at least 80%, at least 90%, at least 95%, at least 97%, or at least 99% of the formulation, by weight. In some embodiments, the water content of the formulation is at least 5%, at least 10%, at least 20%, at least 40%, at least 60%, at least 70%, at least 80%, at least 90%, at least 95%, at least 97%, by weight.

In some embodiments, the weight ratio of the resolubilizing agent to the polymeric chemical agent is at least 1:7, at least 1:5, at least 1:4, at least 1:3, at least 1:2, at least 1:1, at least 2:3, at least 2:1, at least 3:1, at least 4:1, at least 6:1, at least 8:1, at least 10:1, at least 12:1, at least 15:1, or at least 20:1. In some embodiments, the weight ratio of the resolubilizing agent to the polymeric chemical agent is less than 20:1, less than 15:1, less than 12:1, less than 10:1, less than 8:1, less than 6:1, less than 5:1, less than 4:1, less than 3:1, less than 2:1, less than 3:2, or less than 5:4. In some embodiments, the weight ratio of the resolubilizing agent to the polymeric chemical agent being within a range of 1:10 to 20:1, within a range of 1:7 to 20:1, within a range of 1:5 to 15:1, within a range of 1:2 to 15:1, within a range of 1:2 to 10:1, within a range of 1:2 to 7:1, within a range of 1:2 to 5:1, within a range of 1:2 to 4:1, within a range of 1:1 to 10:1, within a range of 1:1 to 7:1, within a range of 1:1 to 5:1, or within a range of 1:2 to 3:1.

In some embodiments, the formulation may have a viscosity of at most 1,500 cP, at most 1000 cP, at most 700 cP, at most 400 cP, at most 200 cP, at most 100 cP, at most 50 cP, at most 30 cP, at most 20 cP, at most 10 cP, or at most 1 cP.

In some embodiments, the formulation may have a pH within a range of 7 to 14, 8 to 13, or 9 to 12.

In some embodiments, the vapor pressure of the resolubilizing agent is less than 0.45 kPa, less than 0.40 kPa, less than 0.35 kPa, less than 0.30 kPa, less than 0.20 kPa, less than 0.10 kPa, or less than 0.05 kPa.

In some embodiments, the resolubilizing agent is stable at a temperature of up to at least 125° C., at least 150° C., at least 175° C., at least 200° C., or at least 225° C. In some embodiments, the formulation is stable at a temperature of up to at least 125° C., at least 150° C., at least 175° C., at least 200° C., or at least 225° C.

In some embodiments, the concentration of the polymeric chemical agent within the formulation is not more than 5 wt. %, not more than 4 wt. %, not more than 3 wt. %, not more than 2 wt. %, not more than 1 wt. %, not more than 0.5 wt. %, not more than 0.4 wt. %, not more than 0.3 wt. %, not more than 0.2 wt. %, not more than 0.1 wt. %, not more than 0.05 wt. %, or not more than 0.01 wt. %.

In some embodiments, the concentration of the resolubilizing agent within the formulation is not more than 5 wt. %, not more than 4 wt. %, not more than 3 wt. %, not more than 2 wt. %, not more than 1 wt. %, not more than 0.5 wt. %, not more than 0.4 wt. %, not more than 0.3 wt. %, not more than 0.2 wt. %, not more than 0.1 wt. %, not more than 0.05 wt. %, or not more than 0.01 wt. %.

In some embodiments, the polymeric chemical agent may have a nitrogen content of at least 1 wt. %.

In some embodiments, the polymeric chemical agent includes, largely includes, or consists essentially of linear polyethylene imine (PEI), branched PEI, modified PEI and combinations thereof. In some embodiments, the weight ratio of the resolubilizing agent to the PEI, within the formulation, is at most 20:1. In some embodiments, the average molecular weight (MW) of the PEI is at least 25,000, at least 50,000, at least 100,000, at least 150,000, at least 200,000, at least 250,000, at least 500,000, at least 750,000, at least 1,000,000, or at least 2,000,000.

In some embodiments, the charge density of the PEI is at least 10 meq/g, at least 11 meq/g, at least 12 meq/g, at least 13 meq/g, at least 14 meq/g, at least 15 meq/g, at least 16 meq/g, at least 17 meq/g, at least 18 meq/g, at least 19 meq/g, or at least 20 meq/g.

In some embodiments, the polymeric chemical agent may have at least one of the following structural properties: (a) its positive charge density is at least 3 meq/g and its average molecular weight being at least 5,000; (b) its positive charge density is at least 3 meq/g and its average molecular weight is at least 1000; (c) the average molecular weight of the chemical agent is at least 50,000; and (d) a nitrogen content of at least 18% and an average molecular weight of at least 10,000. In some embodiments, the polymeric chemical agent may have an average molecular weight of at least 800, at least 1,000, at least 1,300, at least 1,700, at least 2,000, at least 2,500, at least 3,000, at least 3,500, at least 4,000, at least 4,500, at least 5,000, of at least 10,000, at least 15,000, at least 20,000, at least 25,000, at least 50,000, at least 100,000, at least 150,000, at least 200,000, at least 250,000, at least 500,000, at least 750,000, at least 1,000,000, or at least 2,000,000.

In some embodiments, the polymeric chemical agent is selected from the group consisting of a vinyl pyrrolidone-dimethylaminopropyl methacrylamide co-polymer (ViviPrint™ 131), a vinyl caprolactam-dimethylaminopropyl methacrylamide hydroxyethyl methacrylate terpolymer (ViviPrint™ 200), a quaternized copolymer of vinyl pyrrolidone and dimethylaminoethyl methacrylate with diethyl sulfate (ViviPrint™ 650), a guar hydroxypropyltrimonium chloride, a hydroxypropyl guar hydroxypropyltrimonium chloride, and combinations thereof.

In some embodiments, the positively chargeable polymeric chemical agent includes at least one of a cationic [guar-based] polymer and of a cationic [methacrylamide-based] polymer, and the functional group density within said polymeric chemical agent is at least 0.25 meq/g, at least 0.35 meq/g, at least 0.45 meq/g, at least 0.6 meq/g, at least 0.8 meq/g, at least 1 meq/g, at least 2 meq/g, at least 3 meq/g, or at least 5 meq/g.

As noted above, when the ink droplet impinges on the transfer member, the momentum in the droplet causes it to spread into a relatively flat volume. In the prior art, this flattening of the droplet is almost immediately counteracted by the combination of surface tension of the droplet and the hydrophobic nature of the surface of the transfer member, which causes the droplet to bead up regaining spherical shape.

In some instances, the shape of the ink droplet is "frozen" such that at least some and preferably a major part of the flattening and horizontal extension of the droplet present on impact is preserved. It should be understood that since the recovery of the droplet shape after impact is very fast, the methods of the prior art would not effect phase change by agglomeration and/or coagulation and/or migration.

Without wishing to be bound by theory, it is believed that, on impact, the positive charges which have been placed on the surface of the transfer member attract the negatively charged or chargeable polymer resin particles of the ink droplet that are immediately adjacent to the surface of the member. It is believed that, as the droplet spreads, this effect takes place along a sufficient area of the interface between the spread droplet and the transfer member to retard or prevent the beading of the droplet, at least on the time scale of the printing process, which is generally on the order of seconds.

As the amount of charge is too small to attract more than a small number of charged resin particles in the ink, it is believed that the concentration and distribution of the charged resin particles in the drop is not substantially changed as a result of contact with the chemical agent on the release layer. Furthermore, since the ink is aqueous, the effects of the positive charge are very local, especially in the very short time span needed for freezing the shape of the droplets.

Without wishing to be bound by theory, it is believed that in applying a conditioning agent or solution to the surface of the intermediate transfer member, at least one type of positively-charged functional group of the conditioning agent is adsorbed onto, or otherwise attached to, the surface of the release layer. On the opposite side of the release layer, facing the jetted ink drops, at least one type of positively-charged functional group of the conditioning agent is available and positioned to interact with the negatively charged molecules in the ink (e.g., in the resin).

The polymeric resin typically comprised in ink formulations due to interact with such transfer members comprises primarily or exclusively one or more negatively chargeable polymers, such as polyanionic polymers. By a "negatively chargeable polymer" or "negatively chargeable polymer resin" is meant a polymer or polymeric resin which has at least one proton which can easily be removed to yield a negative charge; as used herein, the term refers to an inherent property of the polymer, and thus may encompass polymers which are in an environment in which such protons are removed, as well as polymers in an environment in which such protons are not removed.

In contrast, the term "a negatively charged polymer resin" refers to a resin in an environment in which one or more such protons have been removed. Examples of negatively chargeable groups are carboxylic acid groups (—COOH), including acrylic acid groups (—$CH_2$=CH—COOH) and methacrylic acid groups (—$CH_2$=C($CH_3$)—COOH), and sulfonic acid groups (—$SO_3H$). Such groups can be covalently bound to polymeric backbones; for example styrene-acrylic copolymer resins have carboxylic acid functional groups which readily lose protons to yield negatively-charged moieties. Many polymers suitable for use in inks that may benefit from conditioning solutions according to embodiments of the disclosure, will be negatively charged when dissolved in water; others may require the presence of a pH raising compound to be negatively charged. Commonly, polymers will have many such negatively chargeable groups on a single polymer molecule, and thus are referred to as polyanionic polymers.

Examples of polyanionic polymers include, for instance, polysulfonates such as polyvinylsulfonates, poly(styrenesulfonates) such as poly(sodium styrenesulfonate) (PSS), sulfonated poly(tetrafluoroethylene), polysulfates such as polyvinylsulfates, poly-carboxylates such as acrylic acid polymers and salts thereof (e.g., ammonium, potassium, sodium, etc.), for instance, those available from BASF and DSM Resins, methacrylic acid polymers and salts thereof (e.g., EUDRAGIT®, a methacrylic acid and ethyl acrylate copolymer), carboxymethylcellulose, carboxymethylamylose and carboxylic acid derivatives of various other polymers, polyanionic peptides and proteins such as homopolymers and copolymers of acidic amino acids such as glutamic acid, aspartic acid or combinations thereof, homopolymers and copolymers of uronic acids such as mannuronic acid, galacturonic acid and guluronic acid, and their salts, alginic acid and its salts, hyaluronic acid and its salts, gelatin, carrageenan, polyphosphates such as phosphoric acid derivatives of various polymers, polyphosphonates such as polyvinylphosphonates, as well as copolymers, salts, derivatives, and combinations of the preceding, among various others. In some embodiments, the polymeric resin comprises an acrylic-based polymer, viz. a polymer or copolymer made from acrylic acid or an acrylic acid derivative (e.g., methacrylic acid or an acrylic acid ester), such as polyacrylic acid or an acrylic acid-styrene copolymer. Nominally, the polymeric resin may be, or include, an acrylic styrene copolymer. In some illustrated embodiments, conditioning solutions according to the disclosure satisfactorily treat release layer upon which inks comprising primarily or exclusively an acrylic-based polymer selected from an acrylic polymer and an acrylic-styrene copolymer are deposited. In some instances, the polymeric resin is at least partly water soluble; in some instances, the polymeric resin is water dispersible, and may be provided as an emulsion or a colloid.

Intermediate transfer members amenable to such treatment may include in their release layer, by way of example, silanol-, sylyl- or silane-modified or terminated polydialkylsiloxane silicones, or combinations thereof. Transfer members having such non-limiting exemplary release layers have been disclosed in PCT Publication No. WO 2013/132432.

Chemical agents suitable for the preparation of such conditioning solutions, if required, have relatively high charge density and can be polymers containing amine nitrogen atoms in a plurality of functional groups, which need not be the same, and can be combined (e.g., primary, secondary, tertiary amines or quaternary ammonium salts). Though macromolecules having a molecular weight from several hundred to several thousand may be suitable conditioning agents, the inventors believe that polymers having a high molecular weight of 10,000 g/mole or more are preferable. Suitable conditioning agents may include guar hydroxylpropyltrimonium chloride, hydroxypropyl guar hydroxypropyltrimonium chloride, linear or branched polyethylene imine, modified polyethylene imine, vinyl pyrrolidone dimethylaminopropyl methacrylamide copolymer, vinyl caprolactam dimethylaminopropyl methacrylamide hydroxyethyl methacrylate, quaternized vinyl pyrrolidone dimethylaminoethyl methacrylate copolymer, poly(diallyldimethyl-ammonium chloride), poly(4-vinylpyridine) and polyallylamine.

Further details on conditioning solutions suitable for printing processes wherein water-based inks are jetted onto hydrophobic surface of transfer members and which may be used in printing systems for which the present disclosure can be suitable are disclosed in PCT Publication No. WO 2013/132339.

The efficacy of this method and of the water-based treating solutions associated therewith, also termed "conditioning solutions," was established in laboratory experimental setups and in preliminary pilot printing experiments. As disclosed in the above-mentioned application, the use of such solutions was highly beneficial, as assessed by the print quality of the image following its transfer from the intermediate transfer member to the printing substrate. The optical density of the printed matter was considered of particular relevance and the use of such method of blanket treatment prior to ink jetting clearly improved the measured outcome on the printing substrate. For example, when the substrate was Condat Gloss® 135 gsm coated paper, the optical density of the printed image on the substrate was at least 50% greater than the optical density of the same image when printed under identical conditions but without application of the chemical agent to the release layer. In some embodiments of the method, the optical density (as measured using a Spectrodensitometer (500 Series from X-rite)) is at least 60% greater, at least 70% greater, at least 80% greater, or at least 90% greater. In some embodiments, the optical density is at least 100% greater, at least 150% greater, at least 200% greater, at least 250% greater, at least 300% greater, at least 350% greater, at least 400% greater, at least 450% greater, at least 500% greater, at least 600% greater.

According to the method originally developed by the Applicant, a very thin coating of conditioning solution was applied to the transfer member, immediately removed and evaporated, leaving no more than few layers of the suitable chemical agent. Ink droplets were jetted on such pre-treated blanket, dried and transferred to the printing substrate. Typically, the ink film image so printed could be identified by the presence on their outer surface of the conditioning agent. In other words, the dried ink droplet upon transfer ripped the underlayer of conditioning agent and was impressed on the final substrate in inversed orientation.

It was expected that untransferred residues of conditioning agents (e.g., in areas where no ink was jetted), would readily redissolve in the next cycle, upon the application of a fresh coating of conditioning solution. The operating temperature of the process, which may vary at the different stations along the path the jetted image would follow, but would typically be above 50° C., was expected to facilitate such resolubilization of the residual conditioning agents, if any, in the freshly applied solution. In addition, any such residue was expected to be readily eliminated during cleaning of the transfer member that could take place, if desired, to remove dirt or traces of ink residues that may gather on such member following repeated printing cycles.

In the field, numerous operative parameters were tested, such that the number of runs being performed under a given set of variables was relatively limited, i.e., up to 1,500-3,000 impression repeats. However, upon repeated use of this method in pilot experiments of longer runs (e.g., at least 5,000-10,000 impressions), various undesirable phenomena were found to occur. Perhaps most significantly, the inventors discovered that various above-provided conditioning agents, though based on water-soluble polymers, did not—once dried on the ITM—resolubilize satisfactorily when subjected to a subsequent application of the conditioning solution.

In addition, the inventors have found that low-temperature operation of the image forming station may appreciably complicate or increase the difficulty of the conditioning duty. Without wishing to be limited by theory, the inventors believe that at higher temperatures, the evaporation of the carrier of the ink formulation proceeds at a relatively high rate, which reduces the requisite duty of the conditioning agents with respect to the retardation of droplet beading. However, at lower operating temperatures, the evaporation kinetics may be significantly slower, as are the kinetics for the attraction process between the positively-charged conditioning agents and the negatively-charged functional groups in the ink (typically in the resin).

Moreover, the inventors believe that the kinetics of resolubilization may also be appreciably reduced at lower temperatures, which as elaborated hereinabove, may detract from print image quality.

As the previously disclosed conditioning solutions could lead to undesired buildup of chemical agents having unexpectedly low resolubilization properties, the practical lifetime of the ITM (e.g., the blanket) was shortened, in order to ensure that the surface of the release layer was fresh, or at least sufficiently devoid of such deleterious accumulations to enable satisfactory transfer and print quality. Such accumulations were generally observed on areas of low to null ink coverage (e.g., ink barren areas of a printed image).

The inventors have surprisingly discovered aqueous formulations that act as a conditioning solution, and that facilitate resolubilization of chemical agents (also referred to as "residual conditioning agents"). In some embodiments, the aqueous conditioning formulation may be sufficiently active at low temperatures (Image Forming Station temperatures within a range of 40° C. to 95° C., 60° C. to 95° C., 75° C. to 95° C., 60° C. to 90° C., or 60° C. to 85° C.) to efficaciously interact with various negatively charged molecules in the ink, within the requisite time frame (at most a few seconds), such that beading of the droplet is sufficiently retarded.

The inventive aqueous conditioning formulation may include: a positively chargeable polymeric conditioning agent, typically having an amine functional group, such as a polyethylene imine (PEI), and a resolubilizing agent selected to improve resolubilization of the conditioning agent, both disposed within an aqueous carrier liquid. Typically, the PEI may have an average molecular weight of at least 5,000 and a positive charge density of at least 10 meq/g. Other conditioning agents are amenable to improved resolubilization according to the teaching of the disclosure, as detailed herein below, and though the disclosure is described with reference to PEI, the disclosure needs not be limited to such particular embodiments. The resolubilizing agent may advantageously have, in a pure state, a vapor pressure of less than 0.025, less than 0.020, less than 0.015, less than 0.012, less than 0.010, or less than 0.008 bar at 90° C.

The resolubilizing agent, as a pure substance, may advantageously be a liquid at 20° C. or more, at 30° C. or more, at 40° C. or more, at 50° C. or more, or at 60° C. or more. Without wishing to be bound by a particular theory, it is believed that suitable resolubilizing agents may interact with the conditioning agent by way of steric hindrance, increasing the accessibility of the conditioning molecule to resolubilizing vehicles (e.g., water). The two agents are preferably chemically inert with one another.

The weight ratio of the resolubilizing agent to the conditioning agent (e.g., PEI), within the conditioning formulation, is typically within a range of 1:10 to 20:1, within a range of 1:5 to 20:1, within a range of 1:5 to 15:1, and more typically, within a range of 1:3 to 10:1, within a range of 1:3 to 7:1, within a range of 1:3 to 5:1, within a range of 1:2 to 5:1, or within a range of 1:1 to 5:1.

In some embodiments, the concentration of the resolubilizing agent within the formulation may be not more than 10 wt. %, not more than 5 wt. %, not more than 4 wt. %, not more than 3 wt. %, not more than 2 wt. %, not more than 1 wt. %, not more than 0.5 wt. %, not more than 0.4 wt. %, not more than 0.3 wt. %, not more than 0.2 wt. %, or not more than 0.1 wt. %.

The resolubilizing agent may have a solubility in water, in the carrier liquid, or in the formulation, of at least 1%, at least 3%, at least 5%, at least 10%, at least 20%, at least 30%, at least 40%, at least 50% at 25° C. and a pH of 7. The conditioning agent (e.g., PEI), resolubilizing agent, and carrier liquid may make up at least 50%, at least 60%, at least 70%, at least 80%, at least 90%, at least 95%, at least 97%, or at least 99% of the formulation, by weight.

The PEI may be a linear polyethylene imine, a branched polyethylene imine, a modified polyethylene imine, or combinations thereof. The average molecular weight of the PEI may be at least 5,000, and more typically, at least 25,000, at least 50,000, at least 100,000, at least 150,000, at least 200,000, at least 250,000, at least 500,000, at least 750,000, at least 1,000,000, or at least 2,000,000.

The charge density of the PEI may be at least 10 meq/g, at least 11 meq/g, at least 12 meq/g, at least 13 meq/g, at least 14 meq/g, at least 15 meq/g, at least 16 meq/g, at least 17 meq/g, at least 18 meq/g, at least 19 meq/g, or at least 20 meq/g.

The concentration of PEI within the formulation may be not more than 5 wt. %, not more than 4 wt. %, not more than 3 wt. %, not more than 2 wt. %, not more than 1 wt. %, not more than 0.5 wt. %, not more than 0.4 wt. %, not more than 0.3 wt. %, not more than 0.2 wt. %, not more than 0.1 wt. %, not more than 0.05 wt. %, or not more than 0.01 wt. %.

The conditioning and resolubilizing agents may each individually be stable at a temperature of up to at least 100° C., at least 125° C., at least 150° C., at least 175° C., at least 200° C., or at least 225° C.

The resolubilizing agent may include, mainly include, or consist essentially of at least one sugar, at least one alcohol (e.g., diol, triol, polyol), at least one ether or polyether, at least one amine, at least one polymeric anion salt, at least one amino silicone, or combinations thereof (e.g., agents comprising combined sugar and ether, alcohol and amine functionalities or polyether and amine functionalities).

In some embodiments, the resolubilizing agent is selected from the group comprising cocoamide diethanol amine, ethoxylated methyl glucose ether (e.g., Glucam™ E-10 and Glucam™ E-20), glycerol, pentaerythritol, PEG 400, PEG 600, poly(sodium 4-styrenesulfonate), silicone having amine pendant groups (e.g., SilSense® Q-Plus Silicone having quaternary nitrogen and SilSense® A21 Silicone having secondary and tertiary amine groups), sucrose, triethanolamine, triethylene glycol mono methyl ether, and combinations thereof.

Conditioning compositions comprising conditioning agents and resolubilizing agents according to present teachings may further comprise one or more additives including pH modifiers, viscosity modifiers, stabilizers, preservatives, anti-oxidants, and chelating agents.

Also provided is a method of use of the above described formulations, the method comprising (a) treating an intermediate transfer member (ITM) of a printing system by application of the formulation upon a release surface, the treatment preceding the deposition of an ink image upon the transfer member. The method may further comprise one or more of the following steps: (b) drying the ink image deposited on the ITM, (c) transferring the dried ink image to a printing substrate.

EXAMPLE 1

Conditioning Formulations

Exemplary conditioning solutions that can be used to treat an ITM upon which aqueous ink formulations can be deposited are provided herein below, wherein the amount of the respective ingredients is provided in weight percent (wt. %) of the complete conditioning formulation, the water being deionized:

| | | |
|---|---|---|
| Conditioning Solution A | | |
| PEI Lupasol ® PS (BASF) | 1 | (MW 750,000, ~33% solid) |
| Sucrose | 4 | |
| Water | 95 | |
| Conditioning Solution B | | |
| PEI Lupasol ® P (BASF) | 0.7 | (MW 750,000, ~50% solid) |
| Glycerol | 1 | |
| Water | 98.3 | |
| Conditioning Solution C | | |
| PEI Lupasol ® HF (BASF) | 5 | (MW 25,000, ~56% solid) |
| Triethanolamine | 10 | |
| Water | 85 | |
| Conditioning Solution D | | |
| PEI Lupasol ® WF (BASF) | 2 | (MW 25,000, ~99% solid) |
| Pentaerythritol | 1 | |
| Water | 97 | |
| Conditioning Solution E | | |
| PEI branched, MW 25,000 (Aldrich) | 3 | |
| Polyethylene glycol 400 | 6 | |
| Water | 91 | |
| Conditioning Solution F | | |
| PEI, 80% ethoxylated MW 111,000, 37% water solution (Aldrich) | 4 | |
| Glycerol | 4 | |
| Water | 92 | |
| Conditioning Solution I | | |
| ViviPrint ™ 131 | 2 | (MW 1,500,000-2,000,000, ~11% solid) |
| Glycerol | 2 | |
| Water | 96 | |
| Conditioning Solution J | | |
| ViviPrint ™ 131 | 2 | (MW 1,500,000-2,000,000, ~11% solid) |
| Water | 98 | |

Such conditioning solutions were typically prepared by mixing the conditioning agent with most of the water, adding then the resolubilizing agent and further stirring the mixture. Water was then added to complete the conditioning formulation up to 100 weight parts and the resulting formulation was optionally filtered through a 0.5 micrometer (□m) filter.

Such conditioning solutions can be prepared as concentrated stock to be diluted to the final concentration desired in operation of a relevant printing system. Exemplary concentrated stock of conditioning solutions that can be diluted and then used to treat an ITM upon which the ink formulations can be deposited are provided hereinbelow, wherein the amount of the respective ingredients are provided in weight percent (wt. %) of the stock:

| | | |
|---|---|---|
| Conditioning Stock Solution G | | |
| PEI Lupasol ® P (BASF) | 41.5 | (MW 750,000, ~50% solid) |
| Glycerol | 39 | |
| Water | 19.5 | |
| Conditioning Stock Solution H | | |
| PEI, Lupasol ® PN-50 | 30.5 | (MW 1,000,000, ~49% solid) |
| Triethanolamine | 20.8 | |
| Water | 48.7 | |

EXAMPLE 2

Resolubilization of Dried Conditioning Formulations

The re-solubility of Solution I and Solution J was tested according to the following procedure: each sample (50 ml) was dried for 3 days at 100° C. The dried residue was resuspended with 50 ml of hot water (with heating to 60° C. to accelerate the experiment and to approximate the temperature of the ITM).

Results: the residue of Solution I dissolved almost immediately (in less than 1 second). By contrast, dissolution of Solution J, which was devoid of a resolubilization agent, required 1 minute of intensive shaking.

Effect of Resolubilizing Agents on Resolubilization of Dried Conditioning Agents Once dried, various PEIs found to be generally suitable as conditioning agents do not easily resolubilize in water, even though such PEIs were water soluble or even highly water soluble, ab initio. Some guar-based and Viviprint conditioning agents may suffer from similar phenomena, albeit on a lesser scale.

The dried conditioning agent may therefore accumulate on the blanket, especially on areas on which no ink was jetted. Such areas may be appreciably more susceptible to the accumulation of the dried conditioning agent, with respect to printed-on areas, in which much or all of the dried conditioning agent may be transferred to the printing substrate, along with the ink image, upon impression thereof.

The inventive formulations improve resolubilization, or the kinetics of resolubilization, following drying.

In the experimental program provided below, the inventors assessed whether resolubilization agents (RA) could be added to a conditioning solution comprising, as a conditioning agent (CA), 0.3% wt. PEI to facilitate its resolubilization in water, following extensive drying.

The candidate Resolubilization Agents may be selected from any of the following functional groups: —OH, —NR2, —$N^+R3$, —$SO^{3-}$.

Experimental Procedure:

The conditioning agent tested was PEI Lupasol® PS at 1:100 dilution (i.e., ~0.3% wt. concentration of PEI in the final conditioning composition).

The conditioning solutions were prepared in distilled water using a constant amount of CA (0.3% PEI Lupasol® PS) and increasing amounts of candidate RA at the weight ratio indicated below. The RA was typically at least 99% pure or used as provided by the commercial supplier. Chemicals were purchased from Ashland, Chemrez Technologies, Lubrizol and Sigma-Aldrich.

Conditioning solutions containing about 6 g of solid material were dried for 3 days at 100° C. The dried residue was resuspended with 50 ml of hot water (with heating to 60° C. to accelerate the experiment and to approximate the temperature of the ITM).

Resolubilization was visually assessed and classified either as positive, if visibly achieved, negative if not visibly achieved, or partial. A resuspended sample was classified as partly resoluble if found to contain a fractional quantity of undissolved dried residues. To the extent available, information concerning the estimated average molecular weight of the candidate Resolubilizing Agent, and the number of H-bonding group (meq/g) is also provided. The results are provided below in Table 1.

TABLE 1

| Resolubilizing Agent (RA) Chemical Family Chemical Formula | RA:CA Ratio | Resol. in water | MW | # of H-bonding Groups (meq/g) |
|---|---|---|---|---|
| Reference (PEI Alone) | 0:1 | No | | |
| Ethylene Glycol | 1:5 | No | 62.07 | 32 |
| Diol | 1:1 | No | | |
| $C_2H_6O_2$ | 5:1 | No | | |
| Propylene glycol | 1:5 | No | 76.09 | 26 |
| Diol | 1:1 | No | | |
| $C_3H_8O_2$ | 5:1 | No | | |
| Diethylene Glycol | 1:5 | No | 106.12 | 18 |
| Diol | 1:1 | No | | |
| $C_4H_{10}O_3$ | 5:1 | No | | |
| 2-Amino-2-methyl-1-propanol | 1:5 | No | 89.1 | 22 |
| Amine and Alcohol | 1:1 | No | | |
| $C_4H_{11}NO$ | 5:1 | No | | |
| PEG 8000 | 1:5 | No | ~8,000 | 0.25 |
| Polyether | 1:1 | No | | |
| $C_{2n}H_{4n+2}O_{n+1}$ | 5:1 | No | | |
| PEG 20000 | 1:5 | No | ~20,000 | 0.1 |
| Polyether | 1:1 | No | | |
| $C_{2n}H_{4n+2}O_{n+1}$ | 5:1 | No | | |

TABLE 1-continued

| Resolubilizing Agent (RA) Chemical Family Chemical Formula | RA:CA Ratio | Resol. in water | MW | # of H-bonding Groups (meq/g) |
|---|---|---|---|---|
| PEG 400 | 1:5 | No | ~400 | 5 |
| Polyether | 1:1 | Partly | | |
| $C_{2n}H_{4n+2}O_{n+1}$ | 5:1 | Yes | | |
| Glycerol | 1:5 | No | 92.09 | 32 |
| Triol | 1:1 | Yes | | |
| $C_3H_8O_3$ | 5:1 | Yes | | |
| Triethanolamine | 1:5 | Partly | 149.19 | 27 |
| Amine AND Triol | 1:1 | Yes | | |
| $C_6H_{15}NO_3$ | 5:1 | Yes | | |
| Pentaerythritol | 1:5 | Partly | 136.15 | 29 |
| Polyol | 1:1 | Yes | | |
| $C_5H_{12}O_4$ | 5:1 | Yes | | |
| PVA—Polyvinyl alcohol | 1:5 | No | ~100,000 | |
| Polyol | 1:1 | No | | |
| $(C_2H_4O)_x$ | 5:1 | No | | |
| Poly(sodium 4-styrenesulfonate) | 1:5 | Part | ~70,000 | 4 |
| Polymeric Anion Salt | 1:1 | Yes | 206* | |
| $(C_8H_7NaO_3S)_n$ | 5:1 | Yes | | |
| Poly(diallyldimethylammoniumchloride) | 1:5 | No | ~500,000 | 6 |
| Polymeric Cation Salt | 1:1 | No | 161* | |
| $(C_8H_{16}NCl)_n$ | 5:1 | No | | |
| Sodium Chloride | 1:5 | No | 58 | 0 |
| Inorganic Salt | 1:1 | No | | |
| NaCl | 5:1 | No | | |
| Sucrose | 1:5 | Yes | 342 | 23 |
| Sugar | 1:1 | Yes | | |
| $C_{12}H_{22}O_{11}$ | 5:1 | Yes | | |
| ViviPrint ™ 131 | 1:5 | No | ~2,000,000 | 10 |
| ViviPrint ™ Vinyl based polymers | 1:1 | No | 296* | |
| Vinylpyrrolidone/ Dimethylaminopropylmethacrylamide Copolymer | 5:1 | No | | |
| ViviPrint ™ 200 | 1:5 | No | ~1,500,000 | 8 |
| ViviPrint ™ Vinyl based polymers | 1:1 | No | 443* | |
| Vinylcaprolactam/ Dimethylaminopropylmethacrylamide/ Hydroxyethylmethacrylate Terpolymer | 5:1 | No | | |
| ViviPrint ™ 650 | 1:5 | No | NA | 7 |
| ViviPrint ™ Vinyl based polymers | 1:1 | No | 407* | |
| Quaternized Vinylpyrrolidone Dimethylaminoethyl Methacrylate Copolymer | 5:1 | No | | |
| Nhance ™ 3000 | 1:5 | No | NA | NA |
| Cationic Guar | 1:1 | No | | |
| | 5:1 | No | | |
| Nhance ™ 3196 | 1:5 | No | NA | NA |
| Cationic Guar | 1:1 | No | | |
| | 5:1 | No | | |

*molecular weight of one single unit

EXAMPLE 3

Vapor Pressure Measurement Procedure

Vapor pressure or equilibrium vapor pressure is the pressure exerted by a vapor in thermodynamic equilibrium with its condensed phases (solid or liquid) at a given temperature in a closed system. The equilibrium vapor pressure is an indication of a liquid's evaporation rate and relates to the tendency of particles to escape from the liquid or solid they are part of. A substance with a low vapor pressure at a temperature of interest is considered non-volatile. If the vapor pressure of a material at a temperature of interest is not provided by the supplier of such compound, this characteristic can be assessed as follows.

Vapor pressure can be measured using a conventional thermogravimetric equipment according to a method described by Duncan M. Price in Thermochimica Acta 367-368 (2001) 253-262.

The relationship between volatilization rate and vapor pressure may be described by the Langmuir equation for free evaporation:

$$-\frac{dm}{dt} = p\alpha\sqrt{\frac{M}{2\pi RT}}$$

where dm/dt is the rate of mass loss per unit area, p the vapor pressure, M the molecular weight of the effusing vapor, R the gas constant, T the absolute temperature and a is the vaporization coefficient.

The equipment is calibrated and the coefficient $\alpha$ is found using a pure reference material (n-decane) of known vapor pressure.

Measurements are carried out using thermobalances. Samples are placed in aluminum sample cups of the type used for DSC measurements. For solid samples, the cup is filled completely with material, which is then melted so that a known sample surface area is obtained. Liquid samples are measured directly.

Measurements are carried out in an inert atmosphere, under isothermal conditions at increasing temperatures, using continuous heating for 180 minutes. The rate of mass loss at a constant temperature is found for each tested material and serves for calculation of the vapor pressure. Vapor pressure (kPa) of selected materials at 70, 90 and 110° C. are reported below in Table 2, together with literature values when available.

TABLE 2

| Resolubilizing Agent (RA) Chemical Family Chemical Formula | Boiling Point (° C.) | Vapor pressure at 70° C. (kPa) | Vapor pressure at 90° C. (kPa) | Vapor pressure at 110° C. (kPa) |
|---|---|---|---|---|
| Reference (PEI Alone) | | | | |
| Ethylene Glycol<br>Diol<br>$C_2H_6O_2$ | 197.3 | | | |
| Propylene glycol<br>Diol<br>$C_3H_8O_2$ | 188.2 | 0.625 | 1.375 | 5.375 |
| Diethylene Glycol<br>Diol<br>$C_4H_{10}O_3$ | 245 | 0.0125 | 0.0125 | 0.0625 |
| 2-Amino-2-methyl-1-propanol<br>Amine and Alcohol<br>$C_4H_{11}NO$ | 165 | 0.075 | 0.2 | 0.75 |
| PEG 8,000<br>Polyether<br>$C_{2n}H_{4n+2}O_{n+1}$ | >300 | <0.01 | <0.01 | <0.01 |
| PEG 20,000<br>Polyether<br>$C_{2n}H_{4n+2}O_{n+1}$ | >300 | <0.01 | <0.01 | <0.01 |
| PEG 400<br>Polyether<br>$C_{2n}H_{4n+2}O_{n+1}$ | >250 | <0.01 | <0.01 | <0.01 |
| Glycerol<br>Triol<br>$C_3H_8O_3$ | 290 | 0.004 | 0.019 | 0.05 |
| Triethanolamine<br>Amine And Triol<br>$C_6H_{15}NO_3$ | 335 | <0.01 | <0.01 | <0.01 |
| Pentaerythritol<br>Polyol<br>$C_5H_{12}O_4$ | 276 at 30 mmHg | <0.01 | <0.01 | <0.01 |
| PVA—Polyvinyl alcohol<br>Polyol<br>$(C_2H_4O)_x$ | >300 | <0.01 | <0.01 | <0.01 |
| Poly(sodium 4-styrenesulfonate)<br>Polymeric Anion Salt<br>$(C_8H_7NaO_3S)_n$ | >300 | <0.01 | <0.01 | <0.01 |
| Poly(diallyldimethylammoniumchloride)<br>Polymeric Cation Salt<br>$(C_8H_{16}NCl)_n$ | >300 | <0.01 | <0.01 | <0.01 |
| Sodium Chloride<br>Inorganic Salt<br>NaCl | >300 | <0.01 | <0.01 | <0.01 |
| Sucrose<br>Sugar<br>$C_{12}H_{22}O_{11}$ | >300 | <0.01 | <0.01 | <0.01 |
| ViviPrint ™ 131<br>ViviPrint ™ Vinyl based polymers<br>Vinylpyrrolidone/<br>Dimethylaminopropylmethacrylamide<br>Copolymer | >300 | <0.01 | <0.01 | <0.01 |
| ViviPrint ™ 200<br>ViviPrint ™ Vinyl based polymers<br>Vinylcaprolactam/<br>Dimethylaminopropylmethacrylamide/<br>Hydroxyethylmethacrylate Terpolymer | >300 | <0.01 | <0.01 | <0.01 |
| ViviPrint ™ 650<br>ViviPrint ™ Vinyl based polymers<br>Quaternized Vinylpyrrolidone<br>Dimethylaminoethyl Methacrylate<br>Copolymer | >300 | <0.01 | <0.01 | <0.01 |
| Nhance ® 3000<br>Cationic Guar | >300 | <0.01 | <0.01 | <0.01 |
| Nhance ® 3196<br>Cationic Guar | >300 | <0.01 | <0.01 | <0.01 |

* molecular weight of one single unit

EXAMPLE 4

Effect of Resolubilizing Agent on Resolubility of Conditioning Compositions Dried at 200° C.

Whereas in previous experiments, conditioning solutions containing about 6 g of solid material were dried for 3 days at 100° C. and the dried residues resuspended with 50 ml of 60° C. hot water, in the present study a smaller sample was exposed to higher temperatures for a shorter period of time.

A conditioning composition comprising 1.65% polyethylenimine (PEI) in distilled water (1:20 dilution of BASF Lupasol® PS having a solid content of 33 wt. %) served as control (CC0). The following resolubilizing agents were tested, each added to the control solution at a final concentration of 10 wt. %, and the resulting conditioning compositions (CC) were referred to as CCN, N being the number below assigned to each resolubilizing agent. For example, CC0 was prepared by adding 5 g of PEI to 95 g of water, whereas CC1 was prepared by mixing 10 g of Glycerol (No. 1) and 5 g of PEI in 85 g of water.

| | | |
|---|---|---|
| 1 | Glycerol | (Sigma-Aldrich, >99% pure) |
| 2 | Triethanolamine (TEA) | (Sigma-Aldrich, >99% pure) |
| 3 | Polyethylene glycol (PEG) 400 | (Sigma-Aldrich, MW 380-420) |
| 4 | Polyethylene glycol 600 | (Sigma-Aldrich, MW 570-630) |

The mixtures were stirred to homogeneity and the samples so prepared were tested as follows: 1 ml of each sample was placed on a circular watch glass and placed into an oven heated to 200° C. The samples were left to dry either 30 minutes or 3 hours. The dried residues of the conditioning compositions were then cooled to 60° C. and resuspended in 5 ml of hot water (heated to 60° C. to accelerate the experiment).

Resolubilization was visually assessed and classified either as positive, if visibly achieved, negative if not visibly achieved, or partial. A resuspended sample was classified as partly resoluble if found to contain a fractional quantity of undissolved dried residues.

The experiment was repeated three times for each test samples and the results were summarized in the Table 3.

TABLE 3

| | | Resolubilization of CC dried at 200° C. for | |
|---|---|---|---|
| Sample | RA | 30 minutes | 3 hours |
| Control CC0 | None | No | No |
| CC1 | Glycerol | No | No |
| CC2 | TEA | No | No |
| CC3 | PEG 400 | Yes | Partly |
| CC4 | PEG 600 | Yes | Yes |

EXAMPLE 5

Figure 13:
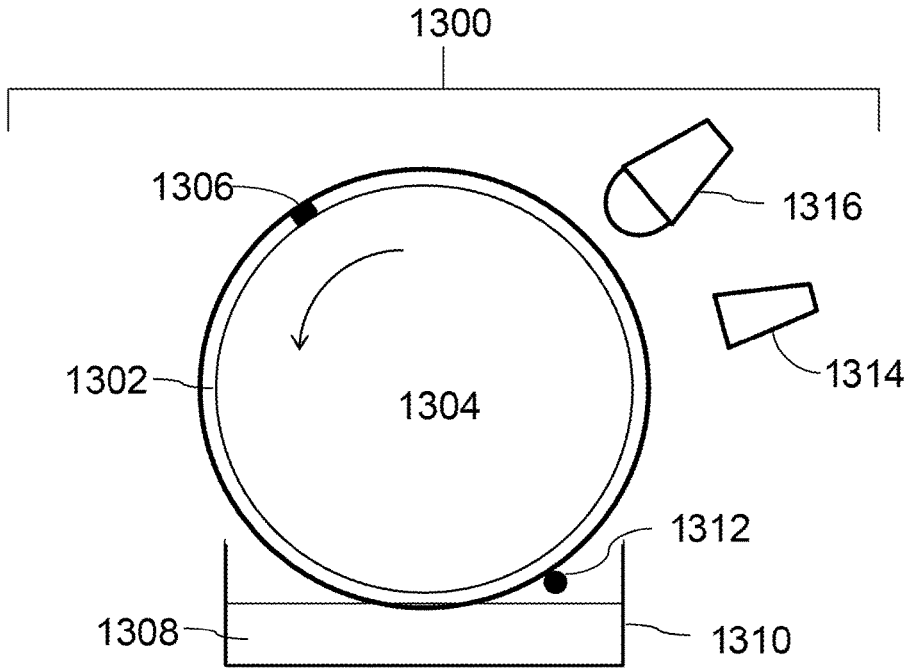
FIG. 13 is a schematic illustration of an experimental setup allowing assessing accumulation of conditioning agents on printing blankets and its reduction in accordance with an embodiment of the disclosure.
Figure 14:
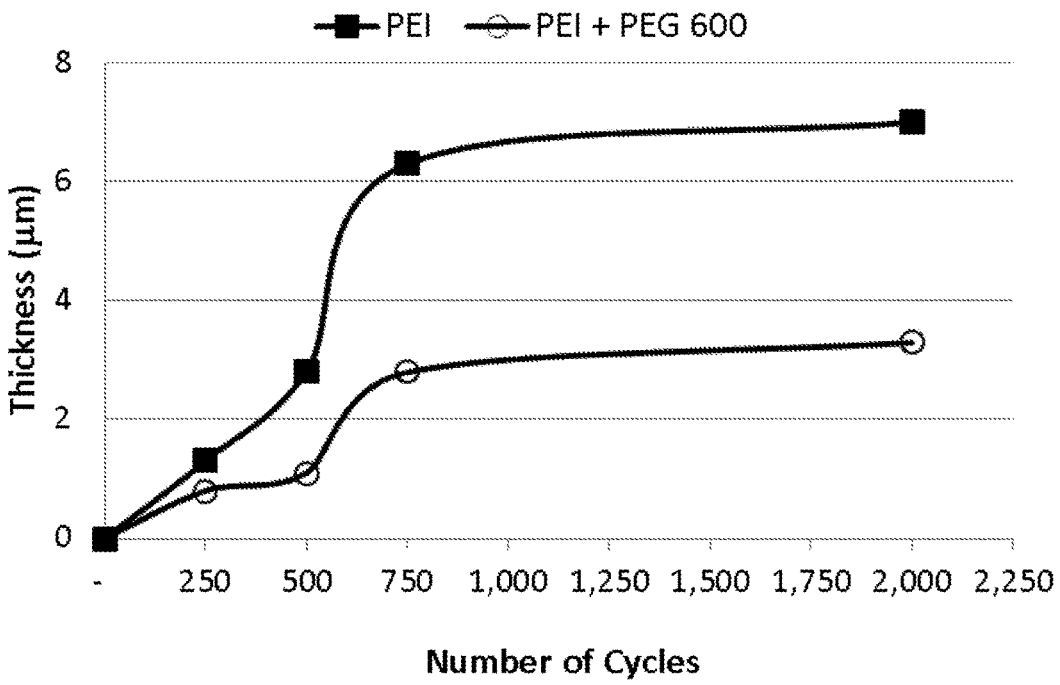
FIG. 14 is a plot showing the measured thickness of dried conditioning compositions as a function of the number of cycles of rotation of a printing blanket in an apparatus as illustrated in FIG. 13.

Effect of Resolubilizing Agent on Resolubility of Conditioning Compositions on Printing Blanket In order to assess the effect of the resolubilizing agent under conditions more relevant to printing systems, the experimental setup illustrated in FIG. 13 was devised: apparatus 1300 an elongate strip of printing blanket 1302 was mounted and attached to a rotatable cylinder 1304, and the ends of the blanket strip were secured one to the other, forming a seam 1306. The cylinder was positioned so that its lower section was in contact (for about 0.5 to 1.0 second) with the conditioning compositions 1308 being tested, placed in a receiving vessel 1310. The temperature of composition 1308 can be monitored and/or maintained as desired. During each cycle, the blanket was sequentially coated with the test solution, wiped of excess liquid by a polyurethane rubber wiper 1312, dried with an air blower (>200° C.) 1314 positioned about 12 cm from the blanket surface, further dried with an infrared (IR) lamp (~150° C.) 1316 positioned about 9 cm away, before reentering the test solution for another cycle. The temperature on the outer surface of the blanket was monitored with an IR gun thermometer and depending on the position relative to the dipping or drying stages, varied between about 100° C. and about 140° C. The temperature of the condition composition tested was about 50° C. Depending on the speed of rotation and size of cylinder, the blanket coated with the tested conditioning solution was dried for a desired duration. The number of cycles was monitored and the cylinder stopped when the desired number of cycles was completed, at which time the rotation was stopped. The blanket was then removed and the accumulation of the conditioning composition under study was assessed. This was done by measuring the thickness of the dried agents above the surface of the blanket using a confocal microscope (LEXT at ×20 magnification and laser scan). The results illustrate the accumulation of conditioning agent in the presence, or absence, of the resolubilizing agent being tested.

In this example, a conditioning composition comprising about 0.33 wt. % polyethylenimine (PEI) in distilled water (1:100 dilution of BASF Lupasol® PS having a solid content of 33 wt. %) served as reference. Unless otherwise stated, the resolubilizing agents were added to the reference composition at a final concentration of 1 wt. %. In the following experiments, the blanket comprised a body for support and a release layer formed thereupon by condensation curing of silanol-terminated polydimethyl siloxane silicone (PDMS), as described in PCT Publication No. WO 2013/132438, which is incorporated herein by reference. As the rotational speed of the cylinder (330 rph) was relatively low, the blanket was exposed to the conditioning compositions and subjected to drying for a duration of time that may be more extensive than in typical commercial printing conditions. For instance, the conditioned blankets were submitted to similar drying periods of 1.5-2 seconds per cycle. Moreover, as no ink images were applied and transferred to paper, steps which would have peeled at least part of the conditioning residues, if not all, it is believed that the above-described laboratory setup can simulate unfavorable conditions. It is to be noted that the pattern of the dried splotches of conditioning compositions in this setup was found to be similar to the accumulations that could be observed in larger scale commercial printing setup in which ink images were jetted upon the conditioned blankets.

Measurements were performed on at least three representative splotches, and the average thickness (in micrometers) is reported in Table 4, in which the effect of 1 wt. % of PEG 600 on the PEI reference is assessed. The relative effect of the tested RA was calculated as a percent of decreased thickness as compared to the maximal thickness of CA in the absence of RA. The results are displayed in FIG. 14.

TABLE 4

| No. of Cycles | Reference: PEI | PEI + PEG 600 | Thickness Reduction |
|---|---|---|---|
| 250 | 1.3 □m | 0.8 □m | 38.5% |
| 500 | 2.8 □m | 1.1 □m | 60.7% |
| 750 | 6.3 □m | 2.8 □m | 55.5% |
| 2000 | 7.0 □m | 3.3 □m | 52.8% |

The positive effect of PEG 600 in reducing accumulation of PEI on the tested printing blanket was further corroborated by measuring the gloss of the printing blanket, using a BYK micro-gloss 75° gloss meter at the beginning and end of the experiment. The gloss was found to be at first 88 Gloss Units (GU), when the blanket strip was new at cycle zero. After 2000 cycles, a blanket exposed to the reference conditioning composition of only PEI displayed a gloss of 75 GU, corresponding to a decrease of about 15%. After the same number of cycles, the blanket exposed to PEI+PEG 600 displayed substantially the same gloss as the baseline, namely 88 GU. These results further support the "protective" effect of this RA under the tested conditions.

Similar blanket coating experiments were performed with additional RAs including amino silicones (SilSense® Q-Plus Silicone and SilSense® A21 Silicone; Lubrizol) cocoamide diethanolamine (Fil Amide 182 of Chemrez Technologies), ethoxylated methyl glucose ethers (Glucam™ E-10 and Glucam™ E-20; Lubrizol), PEG 400 and triethylene glycol monomethyl ether (TGME; Sigma-Aldrich). All displayed satisfactory outcomes, reducing the accumulation of reference PEI over time. Average thicknesses as measured after 250 cycles in apparatus 1300 are provided in Table 5.

TABLE 5

| Conditioning Composition | Average Thickness | Thickness Reduction |
|---|---|---|
| Reference: PEI | 1.3 □m | 00.0% |
| PEI + cocoamide DEA | 1.0 □m | 23.1% |
| PEI + Glucam ™ E-10 | 0.9 □m | 30.8% |
| PEI + Glucam ™ E-20 | 0.7 □m | 46.1% |
| PEI + PEG 400 | 1.2 □m | 07.7% |
| PEI + PEG 600 | 0.8 □m | 38.5% |
| PEI + SilSense ® Q-Plus | 0.4 □m | 69.2% |
| PEI + SilSense ® A21 | 0.7 □m | 46.1% |
| PEI + TGME | 1.1 □m | 15.4% |
| PEI + Sorbitol | 1.3 □m | 00.0% |

As used herein in the specification and in the claims section that follows, the term "hydrogen-bonding functional group" is used as the term would normally be understood by those of skill in the art.

As used herein in the specification and in the claims section that follows, the term "intimately mixed", with regard to a formulation component disposed in a carrier liquid of the formulation, is meant to include dissolution of the component and/or dispersion of the component within the carrier liquid.

As used herein in the specification and in the claims section that follows, the term "ratio" refers to a weight ratio, unless specifically indicated otherwise.

As used herein in the specification and in the claims section that follows, the term "largely includes", with respect to a component within a formulation, refers to a weight content of at least 45%.

The present disclosure has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons skilled in the art to which the invention pertains.

In the description and claims of the present disclosure, each of the verbs, "comprise" "include" and "have", and conjugates thereof, are used to indicate that the object or objects of the verb are not necessarily a complete listing of members, components, elements or parts of the subject or subjects of the verb. As used herein, the singular form "a", "an" and "the" include plural references unless the context clearly dictates otherwise. For example, the term "an impression station" or "at least one impression station" may include a plurality of impression stations.

Although the disclosure has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification, are hereby incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

The invention claimed is:

1. A printing system configured to employ a moving intermediate transfer member, the system comprising:

an image forming station for retaining a plurality of print heads configured to temporarily deposit an image on the intermediate transfer member when the intermediate transfer member in the image forming station is in a first temperature range;

a drying station configured to increase a temperature of the intermediate transfer member from a first temperature in the first temperature range to a second temperature in a second temperature range, the second temperature being substantially higher than the first temperature;

an impression station spaced from the image forming station and configured to transfer the temporarily deposited image from the intermediate transfer member onto a substrate when the intermediate transfer member in the impression station is in the second temperature range;

a cooling station for retaining a coolant, spaced from the impression station and from the image forming station, configured to revert the intermediate transfer member to a temperature in the first temperature range by exposing the intermediate transfer member to the coolant, to thereby enable return of the intermediate transfer member, in the first temperature range, to the image forming station; and a treatment station for applying on a surface of the intermediate transfer member a pre-treatment solution to assist ink droplets from the plurality of print heads to retain a film-like shape after they have impacted the surface of the intermediate transfer member, wherein the cooling station is coincident with the treatment station and is configured such that a same liquid is used for both cooling and treating the intermediate transfer member.

2. The printing system of claim 1, wherein the cooling station is configured to cause the intermediate transfer member to revert to a first temperature of between 40° Celsius and 160° Celsius and wherein at least one heater is configured to cause the intermediate transfer member to reach a second temperature of between 80° Celsius and 220° Celsius.

3. The printing system of claim 1, wherein the cooling station is configured to cause the intermediate transfer member to revert to a first temperature of between 60° Celsius and 90° Celsius and wherein at least one heater is configured to cause the intermediate transfer member to reach a second temperature of between 100° Celsius and 160° Celsius.

4. The printing system of claim 1, wherein the cooling station is configured to cause a temperature of the coolant to be in a range of between 40° Celsius and 90° Celsius.

5. The printing system of claim 1, wherein the second temperature range is selected to increase an ability of the temporarily deposited image to adhere to the substrate rather than adhere to the intermediate transfer member.

6. The printing system of claim 1, wherein the cooling station is configured to spray the coolant onto the intermediate transfer member.

7. The printing system of claim 1, wherein the cooling station is configured to pass the intermediate transfer member through a fountain of coolant.

8. The printing system of claim 1, wherein the cooling station includes at least one roller configured to partially immerse in a reservoir of coolant and to convey coolant to the intermediate transfer member.

9. The printing system of claim 1, further comprising a cleaning station for removing residue from the intermediate transfer member before return to the image forming station, wherein the cooling station is coincident with the cleaning station and is configured such that a same liquid is used for both cooling and cleaning the intermediate transfer member.

10. The printing system of claim 1, further comprising at least one of a coating roller, a fountain, a sprinkler, an air knife, for applying the pre-treatment solution to the intermediate transfer member by means selected.

11. The printing system of claim 10, further comprising at least one of a wiper and an air jet for removing part of the pre-treatment solution from the intermediate transfer member.

12. The printing system of claim 1, wherein the treatment station, through application of the pre-treatment solution, is configured to reverse a polarity of the intermediate transfer member.

13. The printing system of claim 1, wherein the liquid used for both cooling and treating includes a pre-treatment agent consisting of a polymer containing amine nitrogen atoms selected from linear, branched and cyclic, primary amines, secondary amines, tertiary amines and quaternized ammonium groups, the polymer having a high charge density and a molecular weight of at least 10,000 g/mole.

14. The printing system of claim 1, wherein the drying station is configured to expose the intermediate transfer member to heat in a range between 150° Celsius and 250° Celsius.

15. The printing system of claim 1, further comprising an external heater to dry the pre-treatment solution before the intermediate transfer member returns to the image forming station.

16. The printing system of claim 15, wherein an average thickness of the pre-treatment solution after being dried is below 50 nm.

17. A printing method, comprising:

temporarily depositing an initial image on a moving intermediate transfer member when the intermediate transfer member is in a first temperature range;

exposing the intermediate transfer member with the temporarily deposited initial image to heat;

transferring the temporarily deposited image from the intermediate transfer member onto a substrate when the intermediate transfer member is in a second temperature range substantially higher than the first temperature range; and reverting the intermediate transfer member to a temperature in the first temperature range by exposing the intermediate transfer member to a liquid coolant, to thereby enable returning of the intermediate transfer member, in the first temperature range, to the image forming station;

temporarily depositing a consecutive image on the moving intermediate transfer member in a consecutive cycle of the intermediate transfer member after reverting the temperature of the intermediate transfer member to the first temperature range; and applying on a surface of the intermediate transfer member a pre-treatment solution to assist ink droplets to retain a film-like shape after they have impacted the surface of the intermediate transfer member, wherein a same liquid is used for both cooling and treating the intermediate transfer member.

18. The printing method of claim 17, wherein the first temperature range is between 60° Celsius and 90° Celsius and the second temperature range is between 100° Celsius and 160° Celsius.

19. The printing method of claim 17, wherein exposing the intermediate transfer member to the liquid coolant includes at least one of: spraying the coolant onto the intermediate transfer member, passing the intermediate transfer member over a fountain of coolant, and moving the intermediate transfer member using a roller at least partially immersed in a reservoir of coolant.

20. The printing method of claim 17, further comprising:

removing residue from the intermediate transfer member before return to the image forming station, wherein a same liquid is used for both cooling and removing residue from the intermediate transfer member.

* * * * *